US005432537A

United States Patent [19]

Imakawa et al.

[11] Patent Number: 5,432,537

[45] Date of Patent: Jul. 11, 1995

[54] OPTICAL RECORDING APPARATUS CAPABLE OF CONTROLLING OPTICAL POWER OF LASER DIODE ARRAY

[75] Inventors: Susumu Imakawa; Katsumi Yamaguchi, both of Yokohama; Makoto Hino; Norio Michiie, both of Tokyo, all of Japan

[73] Assignee: Ricoh Company, Ltd., Tokyo, Japan

[21] Appl. No.: 62,575

[22] Filed: May 17, 1993

[30] Foreign Application Priority Data

May 18, 1992 [JP] Japan ..... 4-124699
Jan. 25, 1993 [JP] Japan ..... 5-009934

[51] Int. Cl.[6] ..... B41J 2/435
[52] U.S. Cl. ..... 347/133
[58] Field of Search ..... 346/108, 107 R, 76 L, 346/1.1, 160

[56] References Cited

U.S. PATENT DOCUMENTS

| | | | |
|---|---|---|---|
| 4,063,226 | 12/1977 | Kozma et al. | 358/206 |
| 4,733,253 | 3/1988 | Daniele | 346/108 |
| 4,834,477 | 5/1989 | Tomita et al. | 350/6.2 |
| 4,953,171 | 8/1990 | Nakajima et al. | 372/44 |
| 5,002,348 | 3/1991 | Wolf | 359/107 |

FOREIGN PATENT DOCUMENTS

| | | | |
|---|---|---|---|
| 5919252 | 7/1982 | Japan | G11B 7/12 |
| 62-273862 | 5/1986 | Japan | B41J 3/21 |
| 1106486 | 10/1987 | Japan | H01S 3/096 |

OTHER PUBLICATIONS

English language abstract of Japanese Laid-Open application No. 59-19252.
English language abstract of Japanese Laid-Open application No. 62-273863.
English language abstract of Japanese Laid-Open application No. 1-106486.

*Primary Examiner*—Mark J. Reinhart
*Attorney, Agent, or Firm*—Cooper & Dunham

[57] ABSTRACT

An optical recording apparatus comprises a laser diode array including a plurality of laser diodes for producing a plurality of laser beams in response to a drive signal indicative of an image, an optical system for scanning the laser beams on a surface of a photosensitive body, a beam splitting unit for splitting the laser beams produced by the laser diodes to form control laser beams; a driver for driving each of the laser diodes in the laser diode array, an optical detection unit provided for detecting the control laser beams, the optical detection unit including a plurality of photodetectors in correspondence to the laser diodes in the laser diode array in a one-to-one relationship, each of the photodetectors producing an output signal indicative of an optical power of the control laser beam incident thereto, and a control unit supplied with the output signals from the photodetectors in the optical detection unit for controlling the driver such that each of the laser diodes in the laser diode array produces the laser beam with a controlled optical power.

14 Claims, 19 Drawing Sheets

OPTICAL RECORDING APPARATUS CAPABLE OF CONTROLLING OPTICAL POWER OF LASER DIODE ARRAY

BACKGROUND OF THE INVENTION

The present invention generally relates to optical recording apparatuses, and more particularly to an optical recording apparatus for recording an image on a recording medium by means of finely focused optical beams produced by a laser diode array.

Laser printers combine the xerographic technique of image recording with the laser scanning technique for writing images by a finely focused laser beam. Thus, the apparatus has distinct advantages such as high speed operation, high quality printout, capability of recording on ordinary recording sheets, quiet operation, and the like, over other printers such as wire dot printers, thermal printers, ink-jet printers, and the like. Thus, use of laser printers is spreading rapidly in the output device of computers and digital copiers. In relation to the laser diodes, various studies are being made for improving the performance thereof.

For example, Japanese Laid-open Patent Publications 59-19252 and 1-106486 describe a conventional optical image recording apparatus wherein finely focused laser beams, produced by a laser diode array, are deflected to scan a recording surface of a recording medium. The apparatus of the reference thereby monitors the output optical power of the laser diodes during the fly-back interval of the line-by-line scanning process, by means of a back-beam detector or monitor photodetector formed internally to the package of the laser diode array. There, the laser diodes included in the laser diode array are activated one by one in the fly-back interval for monitoring the output optical power of the individual laser diodes. The laser diodes, in turn, are controlled in response to the output of the back-beam detector such that an output optical beams are obtained with a controlled output optical power.

Japanese Laid-open Patent Publication 62-273862 describes another optical recording apparatus that uses a laser diode array, wherein the drive current of the laser diodes is subjected to a periodical resetting process with an interval smaller than the time constant of thermal coupling between the laser diodes. Thereby, the variation of optical output caused by the thermal coupling of laser diodes (a thermally induced interference between laser diodes) is reduced and the output optical power is held substantially constant.

Further, Japanese Laid-open Patent Publication 1-155676 describes an optical recording apparatus that uses back-beams emitted in a backward direction from laser diodes included in a laser diode array, wherein the back-beams are detected by corresponding photodiodes for controlling the output power of the individual laser diodes. In the device of the reference, there are provided shading parts in the receiving surface of the photodiodes for eliminating cross-talk between different back-beams.

FIG. 1 shows the construction of the scanning system used in a conventional laser printer.

Referring to FIG. 1, a laser diode 1 produces a laser beam modulated in response to a modulation signal, and the laser beam thus produced is directed to a rotary mirror 3 after passing through a collimator lens 2. At the rotary mirror 3, the optical beam is deflected and forms a tiny optical spot on a photosensitive drum 5 after passing through a focusing lens (a f-$\theta$ lens) 4. The optical spot thus formed scans the surface of the photosensitive drum 5 in response to the rotational motion of the rotary mirror 3, wherein the photosensitive drum is rotated simultaneously to the rotary mirror 3. Thereby, an electrostatic latent image is formed on the photosensitive drum 5. In addition, there is provided a photodetector 6 at a position offset from the effective scanning range of the optical beam in which the writing is made on the photosensitive drum 5, for controlling the origin or reference position of the recording that is made on the photosensitive drum 5.

In such a laser printer, the photosensitive drum 5 is rotated about a rotary axis thereof with a speed of typically about 500 mm/sec. In correspondence to this, the rotational speed of the rotary mirror 3 is given according to $$R = V_O \times DPI \times 60 \times (25.4 \times N) \quad (1)$$

wherein $V_O$ represents the speed of the drum 5 represented in the unit of mm/sec, DPI represents the number of dots to be recorded per inch, and N represents the number of reflecting surfaces formed on the polygonal rotary mirror 3. Typically, the parameter DPI is set to 300–400, and the parameter N is set to 6–10. In the case when the parameters are set as $V_O=500$, DPI=300, and N=8, it will be understood that the rotary mirror 3 has to rotate with a speed of as much as 44291 rpm.

However, such an extremely fast rotational speed of the mirror 3 poses a difficult problem with respect to the bearing mechanism that provides the axial support of the mirror 3. For example, conventional ball bearing mechanism cannot be used for supporting the axle revolving in such a high speed. Thus, one needs special bearing mechanism such as fluid bearing or magnetic bearing, while use of such special bearing inevitably increases the cost of the apparatus. Further, associated with the use of such a high rotational speed for the rotary mirror 3, one has to use a very high modulation frequency for modulating the laser diode. Thereby, a high data transfer rate is required for transferring data from host machine to the laser control circuit that control the laser diode, and adaptation of the system in conformity with such a high data transfer rate also increases the cost of the apparatus.

In order to meet the stringent requirement of such a high speed operation, a system is proposed wherein the optical source is configured to produce a plurality of laser beams in the form of a laser beam bundle, and wherein a single rotary mirror is used to deflect such a laser beam bundle. Thereby, a plurality of lines are recorded by a single scanning of the laser beam bundle. When one can have M laser beams in the laser beam bundle, the rotary speed of the rotary mirror 3 and the modulation frequency of the laser diode can be reduced by a factor of 1/M, and the cost of the apparatus decreases dramatically.

In order to form such a laser beam bundle, laser diode arrays that includes a number of laser diodes on a common chip is used, wherein the individual laser diodes in the array can be modulated independently from each other. The laser diode array having such a construction is preferable in view point of increased accuracy in the pitch of laser beams on the photosensitive drum. It should be noted that the pitch of the laser beams on the photosensitive drum is determined by the device structure and is affected little by the thermal deformation of the optical system. By using the laser diode array to form an optical beam bundle, one can also simplify the structure of the optical system such that the optical system includes only one set of optical elements such as one collimator lens and one focusing lens.

FIG. 2 shows an example of a laser diode array 7 wherein three laser diodes 8*a*, 8*b* and 8*c* are arranged to form an array. There, it should be noted that the laser diodes 8*a*, 8*b* and 8*c* are aligned with each other and driven independently to produce optical beams modulated independently from each other.

When operating the laser diode array 7 such that the individual laser diodes are modulated independently, there is a tendency that the operation of the individual laser diodes is influenced by the on-off operation of other laser diodes via the thermal interference effect. It should be noted that such a thermal interference effect causes a change of temperature in the individual laser diode device. As the drive current-output optical power characteristics of the laser diodes 8*a*, 8*b* and 8*c* are influenced significantly by the operational temperature, the optical output of the laser diodes 8*a*, 8*b* and 8*c* tends to fluctuate significantly due the thermal interference, even when the laser diodes are driven by a constant drive current. According to the experiment, it was shown that the time constant of thermal interference (thermal coupling time constant) has a value of several milliseconds when the devices are separated from each other by a distance of 100 μm. However, the value of the time constant increases to several hundred microseconds when the separation between the adjacent devices is decreased to 50 μm.

The use of laser diode array as shown in FIG. 2 in the optical recording apparatus raises another problem related to the optical system in that the laser beams forming the laser beam bundle produced by the laser diode array 7 tend to pass through the optical elements such as collimator lens and focusing lens, at a part offset from the optical axis, except for one optical beam that is aligned on the optical axis. Thereby, the optical beams generally experience aberration and the shape of the beam spot deforms inevitably. Further, there is a tendency that the scanning line may be curved due to the aberration of the optical system.

Such a problem of aberration can be minimized by reducing the separation between the laser diodes in the laser diode array 7. However, excessive reduction in the separation between the laser diodes invites the problem of thermal interference of the laser diodes and the optical output of the laser diode changes inevitably. It should be noted that the scanning in laser printers is achieved generally with a period of several milliseconds to several hundred microseconds, and the operation of the laser diodes with such a scanning period inevitably causes the problem of thermal interference in view of the result of experiment mentioned above. In the construction of the Japanese Laid-open Publication 62-273862, for example, it is difficult to control the thermal time constant below the scanning period, and the problem of the output fluctuation by thermal interference appears.

In order to compensate for such a variation of the optical output, the conventional optical recording apparatuses employ optical detectors such as photodetector for monitoring the output power of the laser diodes and for correcting any variation of the output optical power.

FIG. 3 shows the construction of the Japanese Laid-open Application 1-155676, wherein there are provided photodetectors 9*a*, 9*b*, . . . in number corresponding to the number of the laser diodes forming a laser diode array 10, wherein the individual photodetectors 9*a*, 9*b*, . . . are separated from each other by a shade element 11 provided between adjacent photodetectors. Thereby, the shade element 11 eliminates the problem of cross-talk between divergent laser beams produced by the laser diode array 10. In the construction of FIG. 3, however, the overlapping of the divergent beams increases excessively when the separation between the laser diodes is reduced in the laser diode array 10, and the elimination of cross-talk between different laser beams is no longer effectively achieved. Thus, there is a problem in that the device of the reference is not sufficient for providing high quality printout image due to the variation of optical power and cross-talk between the photodetectors.

SUMMARY OF THE INVENTION

Accordingly, it is a general object of the present invention to provide a novel and useful optical recording apparatus, wherein the foregoing problems are eliminated.

Another and more specific object of the present invention is to provide an optical recording apparatus for recording an image by means of an optical beam wherein any variation of optical power of the optical beam is compensated.

Another object of the present invention is to provide an optical recording apparatus, comprising:

a laser diode array including a plurality of laser diodes for producing a plurality of laser beams to form a first optical beam bundle including said plurality of laser beams, each of said plurality of laser diodes being activated independently from each other in response to a drive signal indicative of an image;

an optical system supplied with said first optical beam bundle for focusing each of said laser beams included in said first optical beam bundle, on a surface of a photosensitive body, said optical system including optical scanning means for scanning said first optical beam bundle along a scanning line such that said laser beams included in said first optical beam bundle achieves a scanning over said photosensitive body simultaneously;

beam splitting means provided on a path of said first optical beam bundle between said laser diode array and said optical scanning means, for splitting each of said laser beams to form a second optical beam bundle such that said second optical beam bundle contains laser beams corresponding to the laser beams in said first optical beam bundle and have been split therefrom;

driving means for driving each of said laser diodes forming said laser diode array;

optical detection means provided for detecting said laser beams included in said second optical beam bundle, said optical detection means comprising a plurality of photodetectors corresponding to said laser diodes in said laser diode array in a one-to-one relationship, each of said photodetectors producing an output signal indicative of an optical power of said laser beam incident thereto; and control means supplied with said output signal from said optical detection means for controlling said driving means such that each of said laser diodes in said laser diode array produces said laser beam with a controlled optical power.

According to the present invention, an accurate detection of optical output power is achieved for each of the laser diodes forming the laser diode array by means of the photodetectors provided in correspondence to each of the laser diodes. Thereby, a high precision control of the output optical power becomes possible for the laser diodes in the laser diode array.

In a preferred embodiment of the present invention, said driving means supplies a first forward bias current to each of said laser diodes forming said laser diode array, such that said laser diodes produce said laser beams upon activation; said control means comprising an opto-electric negative feedback loop supplied with said output signal of said optical detection means and further with a control signal given externally, for supplying a second forward bias current to each of said laser diodes in said laser diode array, such that said optical power of said laser diodes, represented by said output signal of said optical detection means, agrees to a predetermined optical power; said driving means and said control means being configured to supply a forward bias current to said laser diodes in said laser diode array as a sum of said first forward biasing current and said second forward biasing current. According to the present embodiment, an accurate control can be achieved with respect to the optical output power for each of the laser diodes forming the laser diode array. Further, by using a high speed and high precision circuit for the control means, one can control the optical power of the laser diodes effectively even when the pulse width of the modulation signal becomes small.

In another preferred embodiment, said optical recording apparatus further comprises a substrate having a principal surface for carrying said laser diode array on said principal surface; said substrate further carrying on said principal surface: a collimator lens forming a part of said optical system such that said collimator lens is held on said principal surface of said substrate by means of a holder element that is mounted on said principal surface of said substrate, said collimator lens converting each of said laser beams produced by said laser diodes from a divergent beam to a parallel beam; photodetectors forming said optical detection means; and said control means; said optical recording apparatus further comprising optical path detour means for directing each of laser beams included said second optical beam bundle produced by said beam splitting means to said corresponding photodetector on said substrate. According to the present invention, the photodetectors are provided on the same substrate on which the laser diodes are provided, and the second optical beam bundle is directed to the photodetectors by the optical path detour means. Thereby, one can minimize the length of conductors connecting the photodetectors forming the optical detection means and the control means, and the effect of noise on the output signal produced by the photodetectors and carried by the conductors is successfully minimized. It should be noted that the photodetectors produce the output signal in the order of several hundred microamperes to several hundred milliamperes.

In another preferred embodiment of the present invention, the optical recording apparatus further comprises optical waveguide means for directing said laser beams in said second optical beam bundle to corresponding photodetectors in said optical detection means. According to the present invention, one can minimize the effect of noise mixed into the output signals of the photodetectors. In addition, as a result of use of optical wave guide such as optical fibers, one can minimize the transmission delay of the output signals.

In another preferred embodiment of the present invention, said laser diode array comprises a single, rear-side optical detection device provided inside a body of said laser diode array for detecting laser beams produced by said laser diodes and emitted in a backward direction that is opposite to a direction of said laser beams that form said first optical beam bundle, said optical recording apparatus further comprising failure detection means supplied with an output signal of said rear-side optical detection device and an output of said optical detection means for comparing the same, said failure detection means producing an alarm signal upon detection of discrepancy between said output signal of said rear-side optical detection device and said output of said optical detection means. According to the present invention, one can detect any anomaly such as a thermally-induced deviation of optical axis in the laser beams that are produced by the laser diode array.

In another preferred embodiment of the present invention, the optical recording apparatus further comprises optical-axis adjusting means provided in a path of said second optical beam bundle for modifying an optical path of said laser beams included in said second optical beam bundle, in response to said alarm signal produced by said failure detection means, wherein least one of said photodetectors includes four photodetecting elements disposed to form a four-quadrant photoreception surface wherein each photodetecting element is disposed in a corresponding quadrant of the photoreception surface. According to the present invention, one can detect any deviation of the optical axis by means of the four photodetecting elements forming said four-quadrant photoreception surface.

In another preferred embodiment of the present invention, said optical scanning means comprises: a rotary polygonal mirror provided rotatably about a rotational axis and having a plurality of reflecting surfaces arranged to surround said rotational axis, for reflecting said laser beams in said first optical beam bundle, said rotary polygonal mirror being provided such that said laser beams in said first optical beam bundle causes said scanning upon rotation of said rotary polygonal mirror; optical shielding means provided to surround said rotary polygonal mirror for shielding said rotary polygonal mirror optically; a first window provided on said optical shielding means for passing said first optical beam bundle radiated from said laser diode array to said rotary polygonal mirror; and a second window provided on said optical shielding means for passing said first optical beam bundle to said photosensitive body after reflection at said rotary polygonal mirror; wherein said first window comprises a semi-transparent mirror for reflecting a part of said first optical beam bundle to form said second optical beam bundle, said semitransparent mirror thereby forming said beam splitting means. According to the present invention, one can reduce the number of parts by using the semi-transparent mirror forming the first window as the beam splitting means.

In another preferred embodiment of the present invention, the optical detection means comprises: at least first and second photodetecting elements for receiving first and second laser beams included in said second optical beam bundle respectively, said first and second photodetecting elements being disposed in alignment with respective optical axis of said first and second laser beams, with respective, mutually different axial positions; and focusing state detection means for detecting a focusing state of said laser beams of said first optical beam bundle on said photosensitive body, based upon output signals of said first and second laser diodes.

Another object of the present invention is to provide an optical recording apparatus, comprising:

a laser diode array including a plurality of laser diodes for producing a plurality of laser beams to form a first optical beam bundle including said plurality of laser beams, each of said plurality of laser diodes being activated independently from each other in response to a drive signal indicative of an image;

an optical system supplied with said first optical beam bundle for focusing each of said laser beams included in said first optical beam bundle, on a surface of a photosensitive body, said optical system including an optical scanning means for scanning said first optical beam bundle along a scanning line such that said laser beams included in said first optical beam bundle achieves a scanning over said photosensitive body simultaneously;

beam splitting means provided on a path of said optical beam bundle between said laser diode array and said optical scanning means, for splitting each of said laser beams to form a second optical beam bundle such that said second optical beam bundle contains laser beams corresponding to the laser beams in said first optical beam bundle and are split therefrom;

focusing means for focusing said laser beams in said second optical beam bundle at a point of convergence;

driving means for driving each of said laser diodes forming said laser diode array;

optical detection means provided for detecting said laser beams included in said second optical beam bundle, said optical detection means comprising a plurality of photodetectors provided in correspondence to said plurality of laser diodes, each of said photodetectors producing an output signal indicative of an optical power of said detected laser beam; and control means supplied with said output signal from said optical detection means for controlling said driving means such that each of said laser diodes in said laser diode array produces said laser beam with a controlled optical power;

said plurality of photodetectors being disposed at an axial position, on respective optical axes of said laser beams in said second optical beam bundle, wherein said axial position is set offset from said point of convergence of said laser beams.

According to the present invention, one can eliminating the effect of local variation of sensitivity in each photodetector, by detecting an averaged intensity of the laser beams.

In a preferred embodiment of the present invention, said optical detection means comprises shading means for surrounding each of said photodetectors such that incidence of laser beams into said photodetectors is prohibited except for the laser beam that has been produced by the corresponding laser diode. According to the present invention, flares from those laser diodes not corresponding to the photodetector under consideration, are effectively eliminated, and the cross-talk is eliminated from the output of the photodetectors.

In another preferred embodiment of the present invention, said laser diode array forms a unitary laser diode array unit; said laser diode array unit including: in addition to said laser diode array, a collimator lens for processing divergent laser beams produced by said plurality of laser diodes included in said laser diode array, first holder means for holding said collimator lens and said laser diode array together, and a print circuit board provided adjacent to said laser diode array at a side opposite to a side in which said laser beams are radiated; wherein said optical recording apparatus further comprises second holder means for holding said beam splitting means and said focusing means together to form a beam splitting unit. According to the present invention, it is possible to use the first holder means for holding both the laser diode array and the collimator lens in the laser diode array unit to form a unitary body that is different from the beam splitting unit. In the conventional optical recording apparatuses, it should be noted that the laser diode array and the collimator lens are generally held separately by different holder mechanisms. Thereby, the present invention provides an advantageous feature in that the adjustment of optical axis of the laser beams and the adjustment of the collimator lens are achieved simultaneously.

In another preferred embodiment of the present invention, said photodetection unit includes an adjustment mechanism for adjusting said photodetectors in said beam splitting unit in alignment with said laser diodes forming said laser diode array. According to the present invention, it is possible to eliminate any deviation in the alignment of laser beams and corresponding photodetectors caused for example by the mechanical errors in the laser diode array or mirrors of the beam splitting means. Thereby, an accurate control of the optical power becomes possible for each of the laser diodes in the laser diode array.

In another preferred embodiment of the present invention, an aperture for limiting a beam diameter is provided in an optical path of the optical beam bundle. According to the present invention, it is possible to reduce the optical loss and simplify the construction of the control means.

Another object of the present invention is to provide an optical recording apparatus, comprising:

a laser diode array including a plurality of laser diodes for producing a plurality of laser beams to form a first optical beam bundle including said plurality of laser beams, each of said plurality of laser diodes being activated independently from each other in response to a drive signal indicative of an image;

an optical system supplied with said first optical beam bundle for focusing each of said laser beams included in said first optical beam bundle, on a surface of a photosensitive body, said optical system including an optical scanning means for scanning said first optical beam bundle along a scanning line such that said laser beams included in said first optical beam bundle achieves a scanning over said photosensitive body simultaneously;

beam splitting means provided on a path of said optical beam bundle between said laser diode array and said optical scanning means, for splitting each of said laser beams to form a second optical beam bundle such that said second optical beam bundle contains laser beams corresponding to the laser beams in said first optical beam bundle and are split therefrom;

focusing means for focusing said laser beams in said second optical beam bundle at a point of convergence;

driving means for driving each of said laser diodes forming said laser diode array;

optical detection means provided for detecting said laser beams included in said second optical beam bundle, said optical detection means comprising a plurality of photodetectors provided in correspondence to said plurality of laser diodes, each of said photodetectors having a photoreception surface and producing an output signal indicative of an optical power of said detected laser beam; and control means supplied with said output signal from said optical detection means for controlling said driving means such that each of said laser diodes in said laser diode array produces said laser beam with a controlled optical power;

said plurality of photodetectors being disposed such that said photoreception surface is set obliquely to an optical axis of said focusing means.

According to the present invention, it is possible to minimize the effect of optical beams returning to the laser diode array after reflection at the photoreception surface.

Other objects and further features of the present invention will become apparent from the following detailed description when read in conjunction with the attached drawings.

DETAILED DESCRIPTION OF PREFERRED EMBODIMENTS

Figure 4:
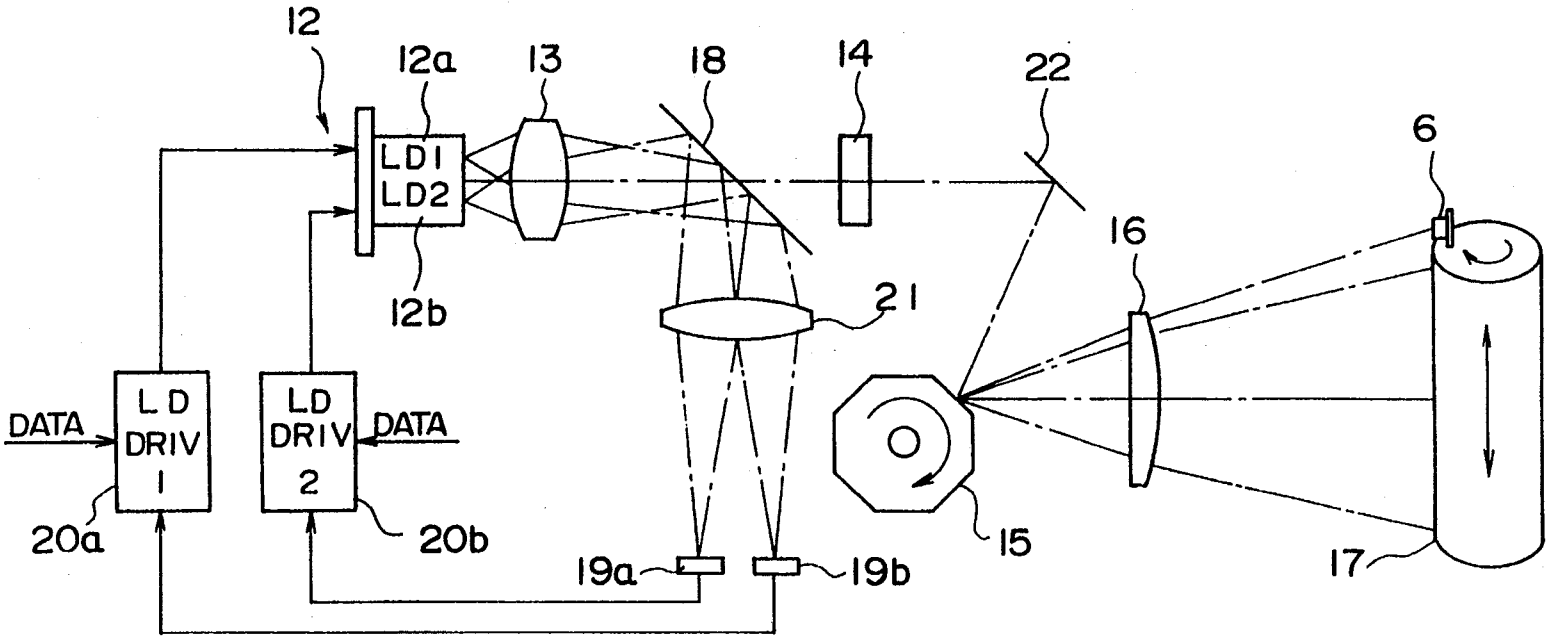
FIG. 4 is a block diagram showing the construction of an optical recording apparatus according to a first embodiment of the present invention.
Figure 5:
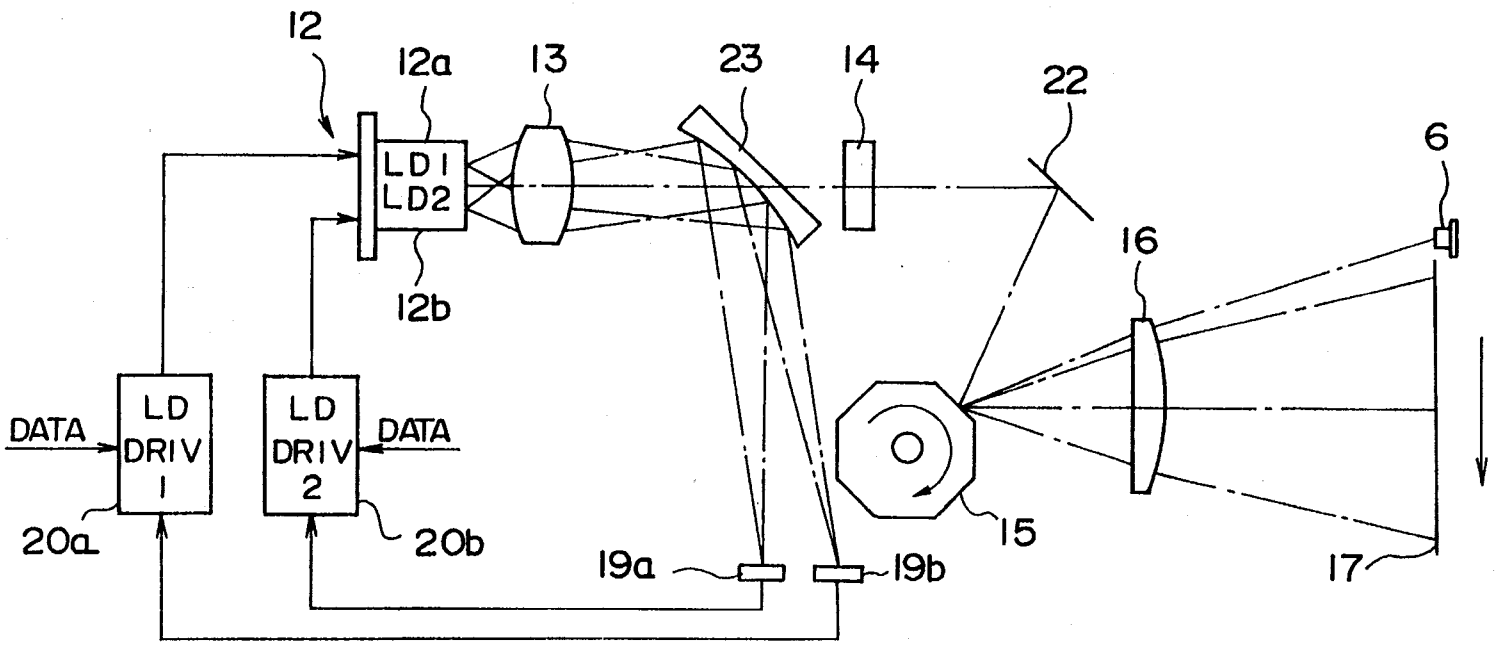
FIG. 5 is a block diagram showing a modification of the apparatus of FIG. 4.
Figure 6:
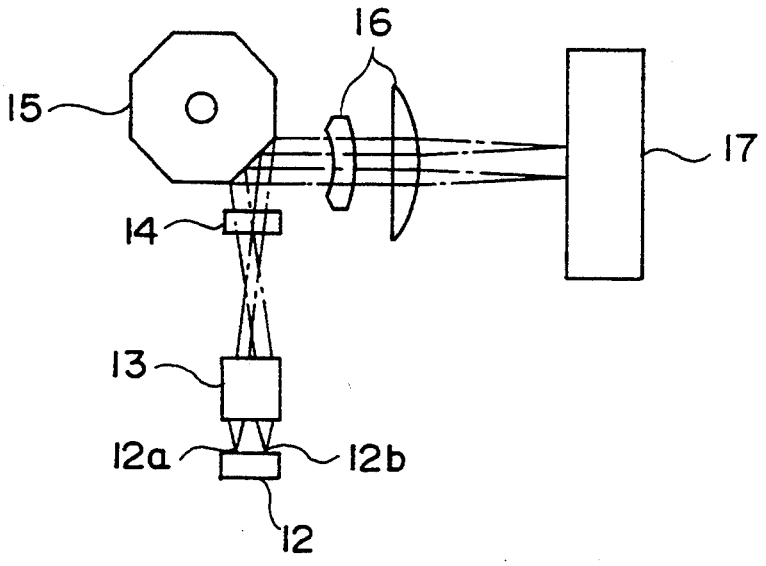
FIG. 6 is a block diagram showing the optical scanning system used in the apparatus of FIG. 4.

FIGS. 4–6 show a first embodiment of the present invention.

Before starting the description of the present invention, a description will be made about the fundamental construction of the optical scanning system used in the apparatus of the present invention, wherein FIG. 6 shows an example of the optical scanning system that uses a laser diode array as an optical source.

Referring to FIG. 6, two laser beams are produced from laser diodes **12*a* and 12*b* that are disposed with a slight separation from each other in the principal scanning direction (scanning direction of the optical beam) and in the secondary scanning direction (feed direction of the recording medium), wherein the laser diodes 12*a* and 12*b* form the respective laser beams as divergent beams. The divergent laser beams thus produced are then converted to parallel optical beams at a collimator lens 13, and the laser beams thus processed at the collimator lens 13 are focused, with respect to the secondary scanning direction, by means of a cylindrical lens 14 in the vicinity of a reflection surface of a rotary polygonal mirror 15. It should be noted that the laser beams processed at the collimator lens 13 form an optical beam bundle including a plurality of parallel laser beams disposed parallel with each other. The rotary polygonal mirror causes a deflection of the laser beams, in response to the rotational motion thereof, and the laser beams thus deflected are focused on a recording medium 17 by means of a f-$\theta$ lens 16 to form a tiny spots thereon. Thereby, an array of the optical spots are formed on the recording medium 17 with a pitch corresponding to the density of the recording dots. The f-$\theta$ lens have different focal points in the principal scanning direction and in the secondary scanning direction and is designed such that the reflection surface of the rotary polygonal mirror 15 and the recording medium 17 form an optically conjugate relationship with respect to the secondary scanning direction. Thereby, any deviation in the pitch of scanning lines caused by the tilting of the reflection surfaces with respect to the rotary axis of the polygonal mirror 15, is successfully compensated. The cylindrical lens 14, on the other hand, acts to adjust the beam diameter on the recording medium 17**, in the secondary scanning direction.

Next, the essential part of the present invention will be described with reference to FIG. 4. In the description hereinafter, those parts described already with reference to FIG. 6 are designated by the same reference numerals and the description thereof will be omitted.

Figure 1:
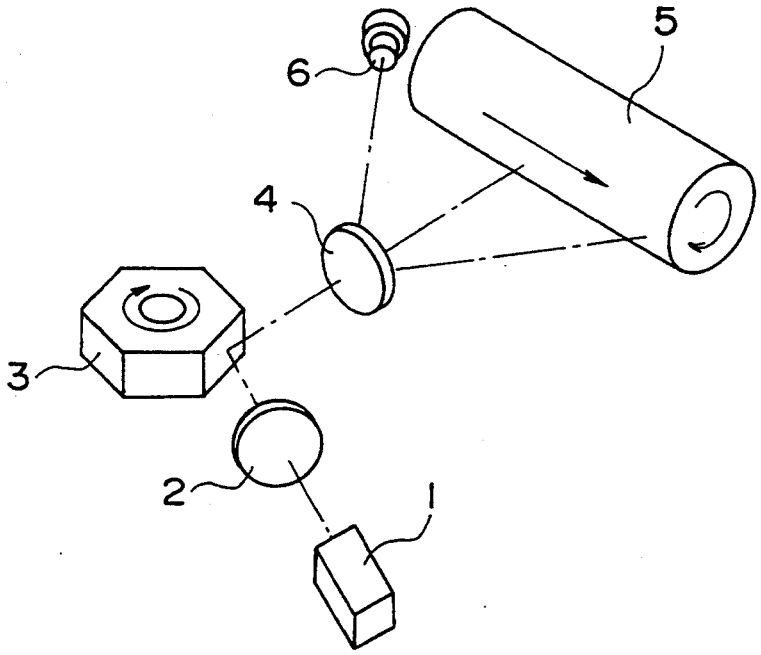
FIG. 1 PRIOR ART
FIG. 1 is a diagram showing the construction of an optical scanning system used in a conventional optical recording apparatus.
Figure 2:
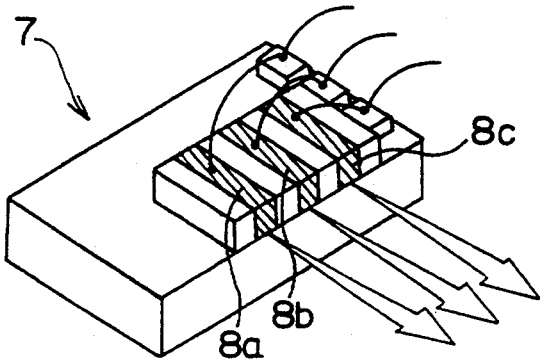
FIG. 2 PRIOR ART
FIG. 2 is a diagram showing an example of the conventional laser diode array used in the optical recording apparatus of FIG. 1.
Figure 3:
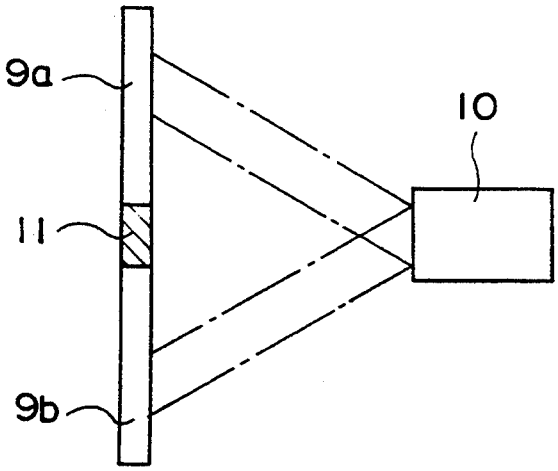
FIG. 3 PRIOR ART
FIG. 3 is a diagram showing the construction used in the conventional optical recording apparatus of FIG. 1 for eliminating cross-talk between photodetectors.

Referring to FIG. 4 showing the case for recording two lines simultaneously by the laser diode array 12 that includes laser diodes 12*a* and 12*b*, there is provided a semi-transparent mirror 18 in the path of the laser beams that are produced from the laser diodes 12*a* and 12*b*, for splitting the respective laser beams. Similarly to the system of FIG. 6, the laser beams thus split at the mirror 18 form another optical beam bundle and are used for controlling the output optical power of the laser diodes 12*a* and 12*b*. Further, in correspondence to each of the laser beams thus split at the mirror 18, photodetectors 19*a* and 19*b* are provided for receiving the split laser beams. Further, in correspondence to each of the photodetectors 19*a* and 19*b*, drivers 20*a* and 20*b* are provided for driving the respective laser diodes 12*a* and 12*b* in the laser diode array 12. In addition, there is provided a lens 21 for focusing the laser beams split at the mirror 18 on the respective photodetectors 19*a* and 19*b*. Between the cylindrical lens 14 and the rotary polygonal mirror 15, there is provided a stationary mirror 22 for deflecting the laser beams passed through the lens 14 to the rotary polygonal mirror 15. Furthermore, the photodetector 6 shown in FIG. 1 is provided outside the image recording region away from the starting edge of scanning.

In the apparatus having such a construction, the laser beams radiated from the laser diodes 12*a* and 12*b* are converted to parallel optical beams at the collimator lens 13, and the parallel beams thus produced are split at the semi-transparent mirror 18 to produce the beams used for controlling the optical power of the laser diodes 12*a* and 12*b*. The laser beams thus split at the mirror 18 are then magnified by a lens 21 and focused at corresponding photodetectors 19*a* and 19*b* that are provided in number corresponding to the number of the laser diodes 12*a* and 12*b*. Thereby, the photodetectors 19*a* and 19*b* produce corresponding electric output signals, and the output signals thus produced are supplied to the laser drivers 20*a* and 20*b* respectively. In response to the electric output signals, the laser drivers 20*a* and 20*b* control the drive current supplied to the corresponding laser diodes 12*a* and 12*b*. It should be noted that the laser beams passed through the semi-transparent mirror 18 are directed to the rotary polygonal mirror 15 via the cylindrical lens 14 and the mirror 22, and cause a recording of the image on the recording drum 17 in response to the rotation of the polygonal mirror 15. As usual, the recording drum is formed of a photosensitive material and rotated about a cylindrical axis thereof.

In the construction of FIG. 4, it is possible to detect and control the output power of the laser diodes 12*a* and 12*b* in the laser diode array 12 accurately. Thereby, it is possible to obtain a high quality image output that is substantially free from variation of recording gradation caused by the variation of output optical power.

FIG. 5 shows a modification of the apparatus of FIG. 4, wherein a concaved half-mirror 23 is used in place of the half-mirror 18 for splitting the laser beams. With the use of the concaved half-mirror 23, it is possible to eliminate the lens 21 used in the apparatus of FIG. 4.

It should be noted that the foregoing construction is applicable also to the optical recording apparatuses wherein the optical system scans an inner or outer surface of a cylindrical recording medium by moving along the axial direction of the recording medium.

Figure 7:
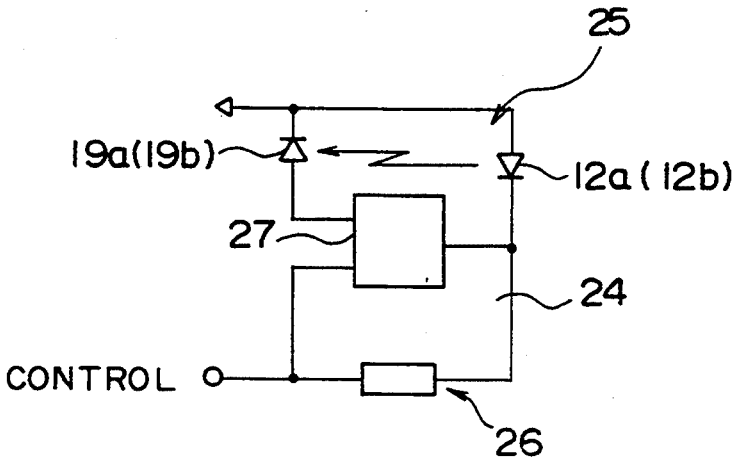
FIG. 7 is a block diagram showing the construction of a drive circuit according to a second embodiment of the present invention.

Next, a second embodiment of the present invention will be described with reference to FIG. 7. In FIG. 7, those parts corresponding to the parts described previously with reference to previous drawings are designated by the corresponding reference numerals.

Referring to FIG. 7, the present embodiment constructs a laser diode control circuit 24 used for controlling a laser diode such as the laser diode 12*a* by an opto-electric feedback loop 25 and a current driver 26 that drives the laser diode 12*a*. The opto-electric feedback loop 25, in turn, includes a comparator 27, a laser diode such as the laser diode 12*a* or 12*b*, and a corresponding photodetector such as the photodetector 19*a* or 19*b*.

There, the opto-electric feedback loop 25 detects the optical output power of the laser diode such as 12*a* or 12*b* by the corresponding photodetector 19*a* or 19*b*, and controls the forward bias current of the laser diode via the comparator 27 such that the output signal of the photodetector, indicative of the output optical power of the laser diode, becomes equal to a control signal that specifies the desired output power of the laser diode. Thereby, the forward bias current is given as a sum of the drive current produced by the current driver 26 and the comparator 27.

In the construction of FIG. 7, it should be noted that the control signal indicative of the desired output optical power of the laser diode is supplied to the comparator 27 and further to the current driver 26 simultaneously, and the output optical power of the laser diode such as the laser diode 12*a* is detected by the corresponding photodetector 19*a*. There, the comparator 27 is supplied further with the output of the photodetector 19*a* and compares the same with the foregoing control signal. Thereby, the comparator 27 increases or decreases the output current supplied to the laser diode 12*a* as the forward bias current, based upon the result of comparison, such that the output optical power of the laser diode 12*a* is held at the desired level. It should be noted that the desired level is set in accordance with the characteristics of the laser diode, and the laser diode 12*a*, the photodetector 19*a* and the comparator 27 form an opto-electric negative feedback loop as mentioned previously.

It should be noted that the step response characteristics of the laser diode 12a is given as $$P_{out}=PL+(PS-PL)\ exp(-2\pi f_0 t)$$

where a DC gain of 10,000 is assumed. In the foregoing equation, $f_0$ represents the cross-frequency of the opto-electric loop in the open loop state, PL represents the optical output power at $t=\infty$, and PS represents the optical power set by the current driver 26. In the opto-electric feedback loop having the DC gain of 10,000, it is judged that the optical power PL is equal to the preset power when the deviation between the $P_{out}$ and PL is equal to or less than 0.1%. Thus, when the power PS is equal to PL, the output power $P_{out}$ of the laser diode 12a becomes equal to the power PL instantaneously. Further, even when the power PS has changed by about 5% for example by external disturbance, the deviation of the output power $P_{out}$ with respect to the power PS becomes equal to or less than 0.4% after 10 ns, provided that the frequency $f_0$ is set to about 40 MHz.

In the construction of FIG. 7, it should be noted that control circuit 24 is provided in number corresponding to the number of the laser diodes that is subjected to the feedback control. By using a high speed, high precision and high resolution circuitry for the circuit 24, it is possible to control the output power of the laser diode accurately even when the pulse width of the drive current is very small. Thus, an accurate control of optical power can be achieved according to the construction of FIG. 7.

Next, a third embodiment of the present invention will be described with reference to FIGS. 7 and 8, wherein those parts described previously with reference to preceding drawings are designated by the corresponding reference numerals. The present embodiment provides a construction wherein the optical source and the photodetectors are assembled into a unitary or integral body.

Figure 8:
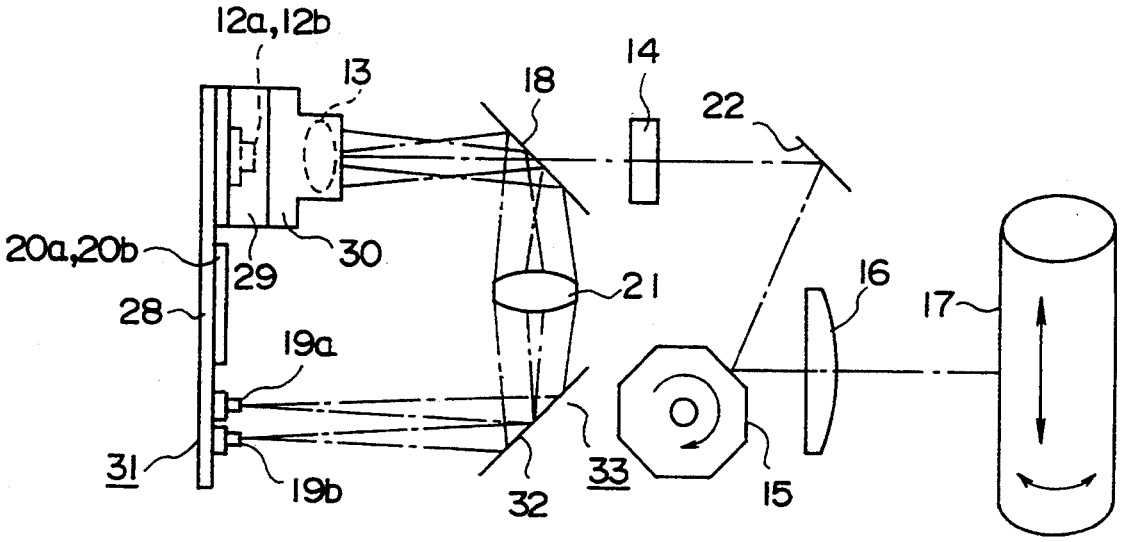
FIG. 8 is a block diagram showing the construction of an optical recording apparatus according to a third embodiment of the present invention.

Referring to FIG. 8, it will be noted that there is provided a printed circuit board 28 for carrying the laser diodes 12a and 12b as well as the photodetectors 19a and 19b thereon. The laser diodes 12a and 12b are surrounded by a holder member 29 for holding the laser diodes on the printed circuit board 28, and another holder member 30 is provided on the holder member 29 for carrying the collimator lens 13. Thus, the printed circuit board 28 forms, together with the laser diodes 12a and 12b as well as the photodetectors 19a and 19b, a unitary, integral layer diode array unit 31.

In the construction of FIG. 8, the semi-transparent mirror 18 is provided on the optical path of the laser beams radiated from the laser diodes 12a and 12b, for splitting the laser beams supplied thereto to form the laser beams used for controlling the laser diodes. Further, the laser beams thus split at the mirror 18 are passed through a lens 21, and the lens 21 focuses the laser beams upon the photodetectors 19a and 19b, after deflecting at a mirror 32. Thereby, the mirror 32 acts as optical path detour means 33 for changing the optical path of the laser beams that have passed through the lens 21. In addition, the printed circuit board 28 carries thereon a control circuit corresponding to drivers 20a and 20b of FIG. 4 or the circuit 24 of FIG. 7.

Figure 9:
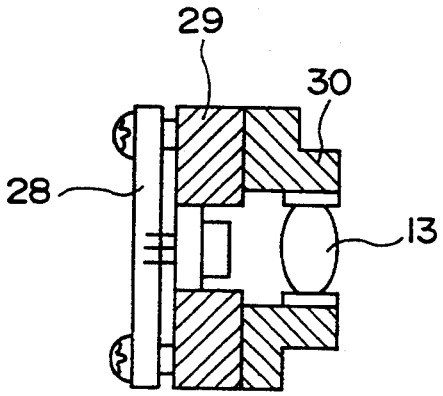
FIG. 9 is a diagram showing the construction of a laser diode array unit used in the apparatus of FIG. 8 in cross sectional view.

FIG. 9 shows the state of mounting the laser diode 12a or 12b and the collimator lens 13 on the printed circuit board 28. It will be seen that the holder member 29 is fixed upon the printed circuit board 28 by means of screws, and the like, and the holder member 30 is mounted upon the holder member 29. Thereby, the holder member 30 holds the collimator lens 30 in alignment with the optical axis of the laser beam that has been produced by the laser diode.

In the present embodiment, the photodetectors 19a and 19b are provided on the printed circuit board 28 that carries simultaneously thereon the control circuit 20a, 20b. Thereby, the transmission of feeble electric output signals of the photodetectors 19a and 19b, typically in the order of several hundred microamperes to several milliamperes, can be achieved directly over the conductor pattern on the board 28, with a minimum distance. Thus, the circuit of the present embodiment is immune to noise. Further, delay in the output control signal of the photodetectors is minimized during the transmission, and an accurate control of optical output power can be achieved even when the drive current pulses are supplied to the laser diodes with extremely small pulse widths.

Figure 10:
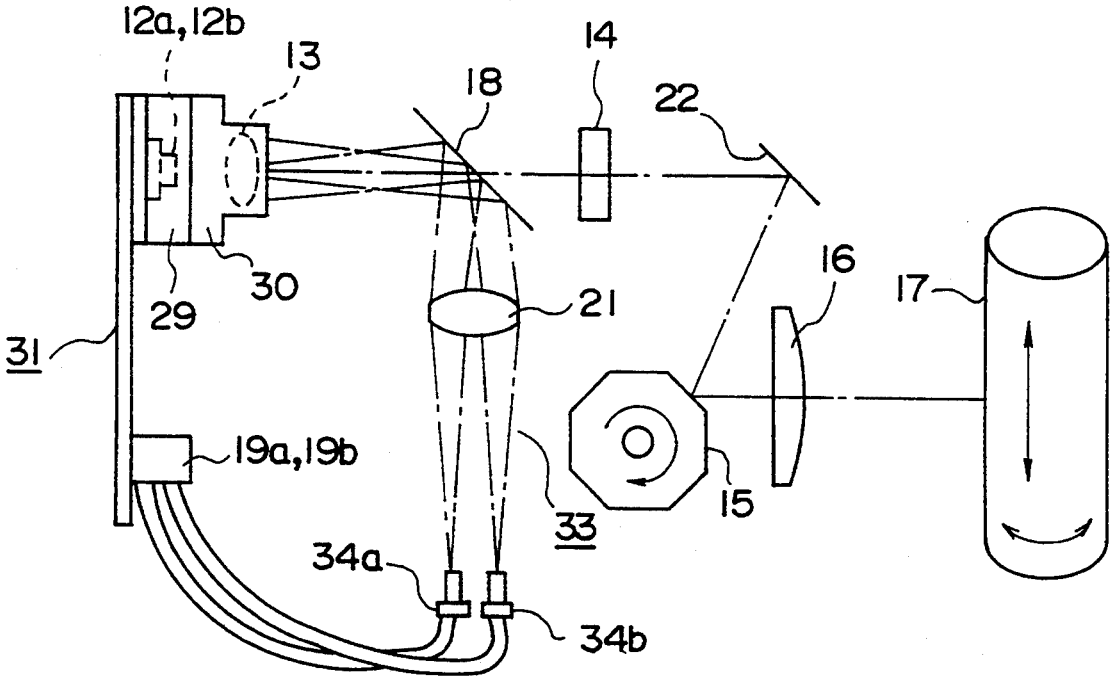
FIG. 10 is a block diagram showing the construction of an optical recording apparatus according to a fourth embodiment of the present invention.

Next, a fourth embodiment of the present invention will be described with reference to FIG. 10, wherein those parts that have been described previously with reference to previous drawings are designated by corresponding numerals.

In the present embodiment, optical fibers 34a and 34b are used for directing the laser beams split at the mirror 18 and focused by the lens 21, to the photodetectors 19a and 19b. Thereby, the optical fibers 34a and 34b form a part of the optical path detour means 33. The lens 21 focuses the laser beams produced by the laser diodes 12a and 12b with magnification, so that the individual laser beams are separated from each other and focused upon corresponding optical fibers 34a and 34b. The laser beams thus injected into the optical fibers 34a and 34b are guided along the fibers 34a and 34b and reach the photodetectors 19a and 19b.

According to the construction of the present embodiment, it is possible to eliminate the problem of transmitting feeble electric signals, detected by the photodetectors, via interconnection wires over a substantial distance. Thereby, the present embodiment provides an improved signal-to-noise ratio and eliminate the problem of signal delay. Thus, one can achieve an accurate control of the optical power of individual laser diodes, even when drive signal pulses are supplied with extremely small pulse widths.

Next, a fifth embodiment of the present invention will be described with reference to FIGS. 11 and 12, wherein those parts described previously with reference to preceding drawings are designated by the same reference numerals and the description thereof will be omitted.

In the present embodiment, there is provided a single photodetector 37 within a package 36 of the laser diodes. There, it should be noted that the package 36 accommodates therein a chip 35 on which the laser diodes 12a and 12b are formed as shown in FIG. 12. The photodetector 37 is disposed in the package 36 so as to detect the back beams that are the laser beams produced by the laser diodes 12a and 12b in a direction opposite to the normal optical path that extends toward the collimator lens 13. Further, as shown in FIG. 11, there is provided a comparator 38 for comparing the electrical output of the photodetectors 19a and 19b with the electrical output of the photodetector 37. The comparator 38 thereby activates an alarm system not illustrated when there is a decrease of optical power detected by the photodetectors 19a and 19b as compared with the optical power detected by the photodetector 37.

Figure 11:
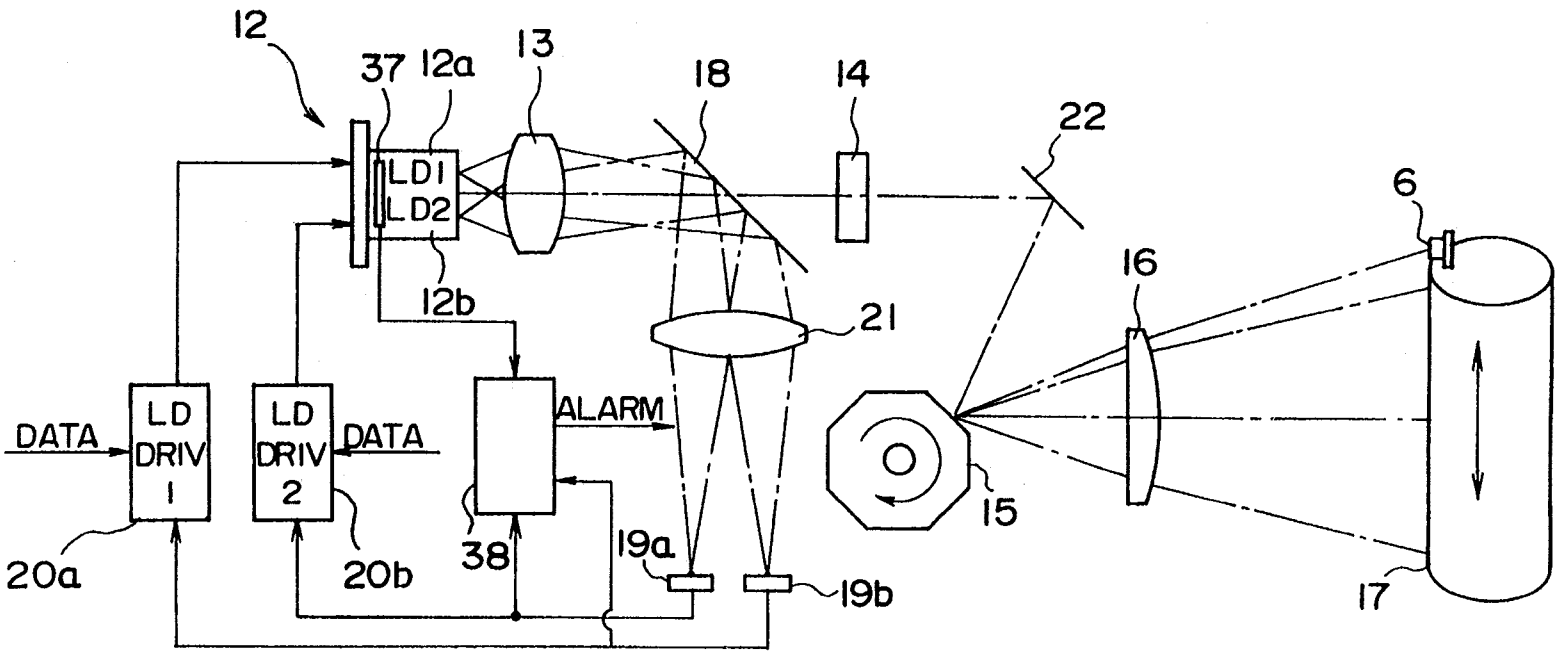
FIG. 11 is a block diagram showing the construction of an optical recording apparatus according to a fifth embodiment of the present invention.
Figure 12:
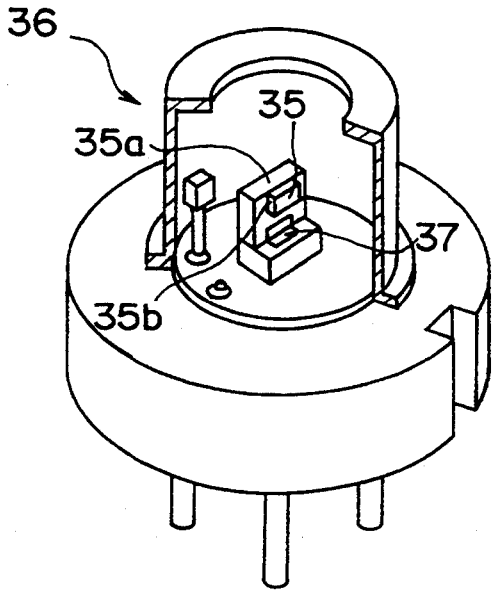
FIG. 12 is a diagram showing the interior of a laser diode array package used in the apparatus of FIG. 11.

In the foregoing construction of FIG. 11, it should be noted that the photodetector 37, disposed adjacent to the laser diodes 12a and 12b in the same package 36, detects the output laser beam of the laser diodes 12a and 12b with reliability. On the other hand, in view of the long optical path of the laser beams extending from the laser diodes 12a and 12b to the photodetectors 19a and 19b, there are chances that the optical axis deviates from the normal state due to various reasons such as thermal deformation. By detecting the improper alignment of the photodetectors 19a and 19b with respect to the optical axis of the laser diodes, one can avoid the problem of excessively boosting the drive current to the laser diodes 12a and 12b in response to the apparent detection of decrease of the optical output power at the photodetectors 19a and 19b. It should be noted that such an excessive boosting can result in damaging of the laser diodes 12a and 12b. It should be noted that such a diagnosis procedure is achieved during the idling interval or startup interval of the optical recording apparatus wherein the recording of image is not in progress.

Next, a sixth embodiment of the present invention will be described with reference to FIGS. 13–16, wherein those parts described previously with previous drawings are designated by the corresponding reference numerals.

Figure 13:
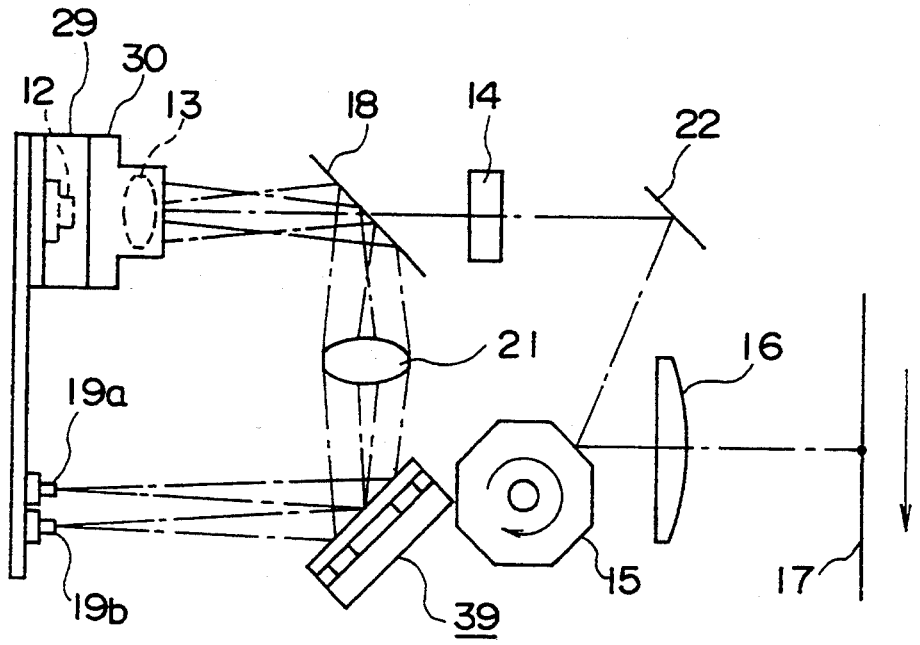
FIG. 13 is a block diagram showing the construction of an optical recording apparatus according to a sixth embodiment of the present invention.

Referring to FIG. 13, the present embodiment employs an adjusting element 39 provided in a path of the laser beams that is split at the mirror 18 and directed to the photodetectors 19a and 19b via the lens 21, for adjusting the optical axis of the laser beams.

Figure 14:
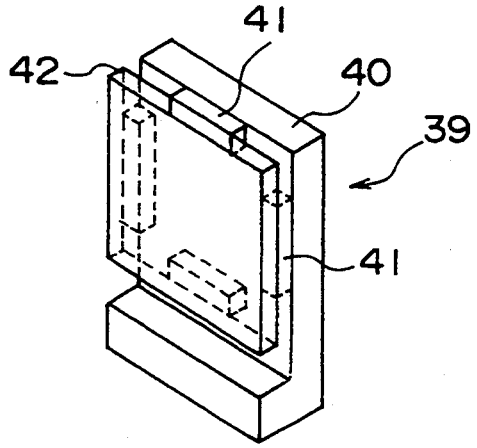
FIG. 14 is a diagram showing an example of optical axis adjusting mechanism used in the apparatus of FIG. 13.
Figure 15:
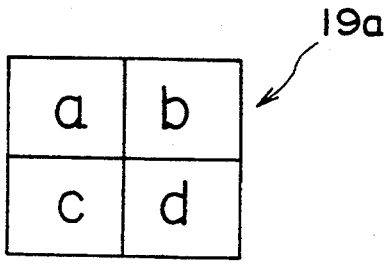
FIG. 15 is a diagram showing a quadrant photoreception surface of a photodetector used in the apparatus of FIG. 13.
Figure 16:
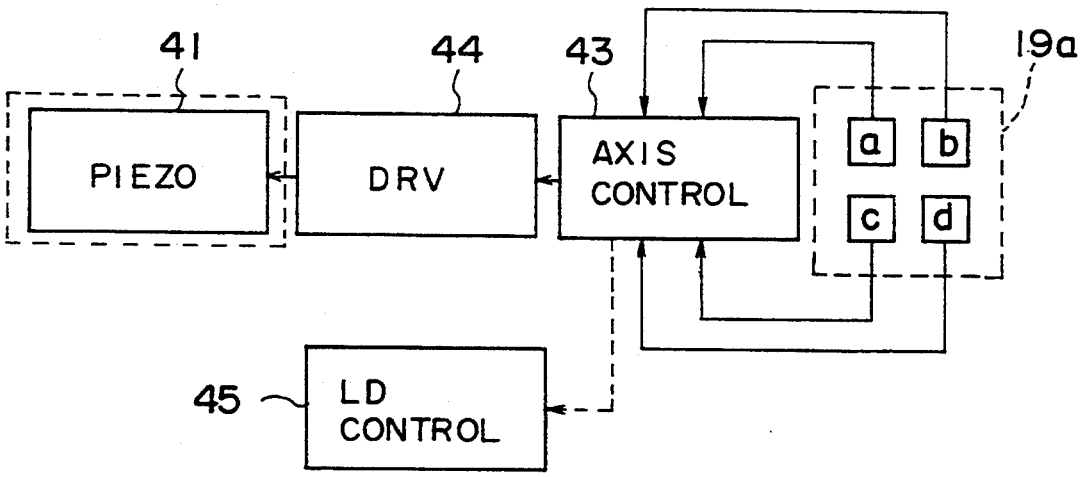
FIG. 16 is a block diagram showing the construction of a driver circuit used in the apparatus of FIG. 13 for driving the laser diodes.

FIG. 14 shows the element 39 in detail. The adjusting element 39 includes a base member 40 that carries thereon a mirror 41, wherein the mirror 41 is held upon the base member 40 by a plurality of piezoelectric elements 41. There, at least one of the photodetectors 19a and 19b has quadrant photoreception surfaces a–d as shown in FIG. 15, and there are provided photodetector elements in correspondence to each of the photoreception surfaces a–d.

The adjustment of the optical axis is achieved by actuating the piezoelectric elements 41 via a control circuit 43 based upon the output signals of the foregoing photodetector elements. More specifically, the control circuit 43 is supplied with the output signals of the photodetector elements a–d and detects the deviation of the optical axis by comparing the output signals thus supplied thereto. Further, the control circuit 43 produces control signals in correspondence to each of the piezoelectric elements 41 such that the output signals of the photodetector elements a–d have substantially the same output level. The control signal thus produced by the control circuit 43 is supplied to a driver circuit 44 that in turn produces drive signals for actuating the individual piezoelectric elements a–d, in response thereto. Thereby, the laser beam reflected at the mirror 42 is deflected by a minute angle. In addition, the output signals of the photodetector elements a–d are added with each other to form a signal indicative of the sum of the output signals of the photodetector elements a–d, and the signal thus produced is supplied to a control circuit 45 that drives the laser diode 19a . The control circuit 45 corresponds to the control circuit 20b of FIG. 11.

It should be noted that the foregoing adjustment of the optical axis is achieved during the idling interval or startup interval of the optical recording apparatus.

Next, a seventh embodiment of the present invention will be described with reference to FIGS. 17 and 18, wherein those parts described previously with reference to previous drawings are designated by the same reference numerals.

Figure 17:
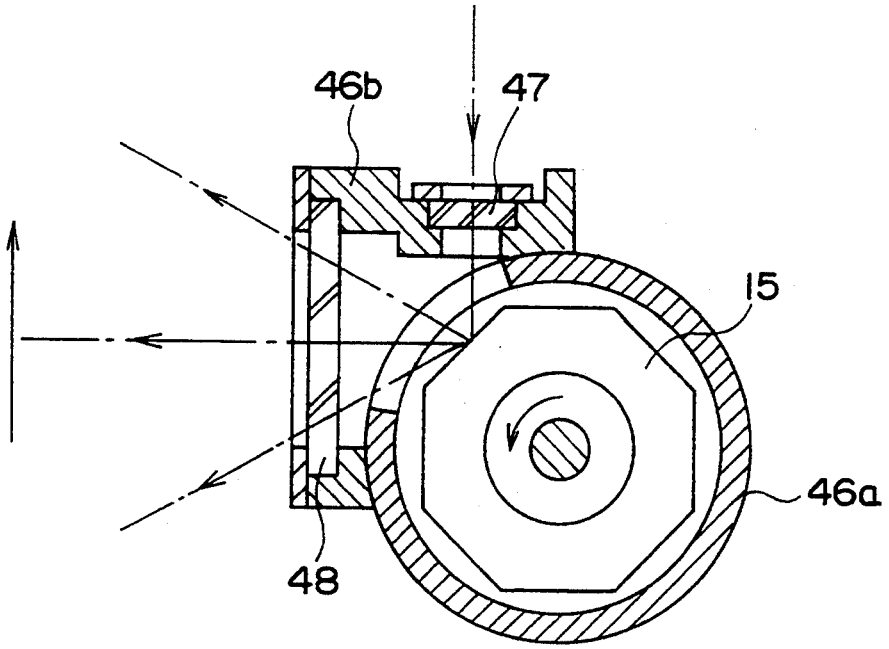
FIG. 17 is a diagram showing the construction of a rotary polygonal mirror according to a seventh embodiment of the present invention.

Referring to FIG. 17, there are provided optical shading members 46a and 46b to cover the rotary polygonal mirror 15, wherein the optical shading member 46a surrounds the rotary polygonal mirror 15. The shading member 46a is provided with a cutout acting as a passage of the laser beams, and the optical shading member 46b is provided with a semi-transparent mirror 47 for receiving and further for splitting incident laser beams. There, the laser beams split at the semi-transparent mirror 47 are used for controlling the laser diodes 12a and 12b as shown in FIG. 18.

The cutout on the shading member 46a is formed in alignment with the optical path of the laser beams that enter to the semi-transparent mirror 47, and the rotary polygonal mirror 15 is provided to deflect the laser beams thus passed through the semi-transparent mirror 47 and further through the cutout on the shading member 46a, by causing a reflection. Further, in alignment to the optical path of the laser beams thus reflected at the mirror 15, there is provided a transparent window 48 on the shading member 46b for passing the reflected beams therethrough.

Figure 18:
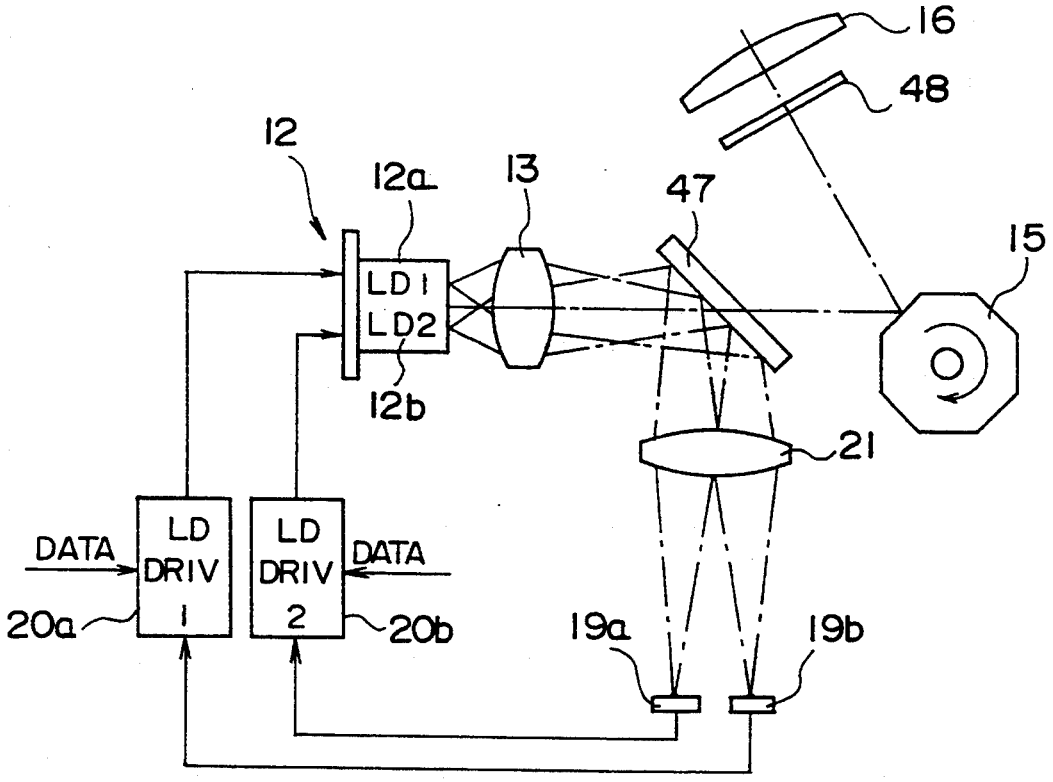
FIG. 18 is a block diagram showing the construction of an optical recording apparatus wherein the rotary polygonal mirror of FIG. 17 is used.

Thereby, it should be noted that the semi-transparent mirror 47 is provided with an angle with respect to the optical path of the incident laser beams as represented in FIG. 18, such that the reflected beams do not return in the direction opposite to the direction of incidence.

In the construction of FIG. 18, the laser beams reflected at the semi-transparent mirror 47 are magnified at the lens 21 and form a beam spot pattern at a focal plane thereof such that beam spots in the beam spot pattern are formed with a separation from each other. Further, the photodetectors 19a and 19b are provided in correspondence to each of the beam spots thus formed for receiving each of the laser beams. Further, the photodetectors 19a and 19b produce electrical output signals that are supplied to the corresponding control circuits 20a and 20b, and the control circuits 20a and 20b control the drive currents supplied to the corresponding laser diodes 12a and 12b as usual, such that the output optical power of the laser diodes 12a and 12b is set at a desired level. On the other hand, the laser beams that have passed through the semi-transparent mirror 47 are reflected at the rotary polygonal mirror 15 and cause a recording of image on the photosensitive drum 17 not illustrated in FIG. 18, as usual.

In the present embodiment that uses the semi-transparent mirror 47 for splitting the laser beams, one can eliminate the semi-transparent mirror 18 and the number of parts used in the apparatus is reduced. In addition, the foregoing construction of confining the rotary polygonal mirror 15 in the optical shading members 46a and 46b is preferable in view point of reducing the noise.

Next, an eighth embodiment of the present invention will be described with reference to FIGS. 19 and 20, wherein those parts described previously with reference to previous drawings are designated by the corresponding reference numerals.

Figure 19:
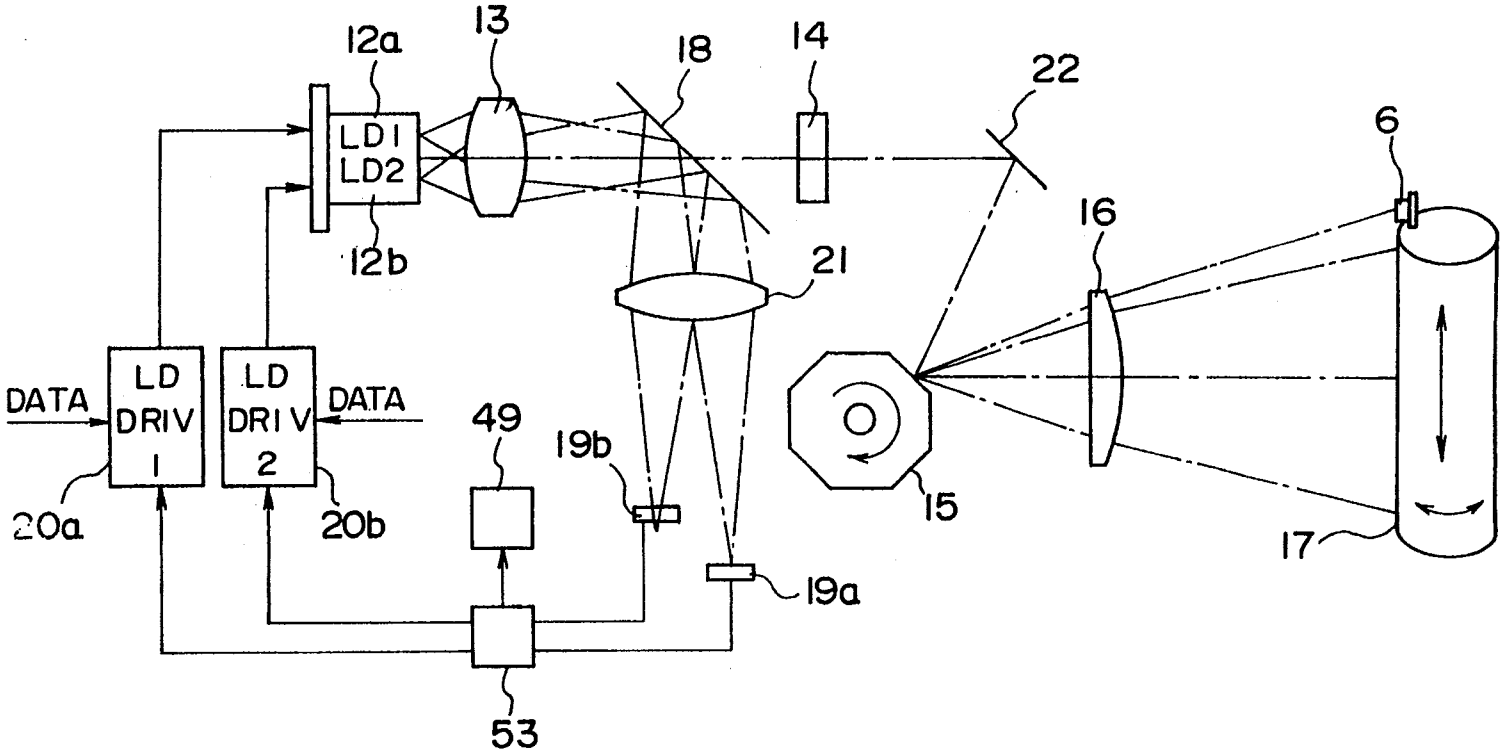
FIG. 19 is a block diagram showing the construction of an optical recording apparatus according to an eighth embodiment of the present invention.
Figure 20:
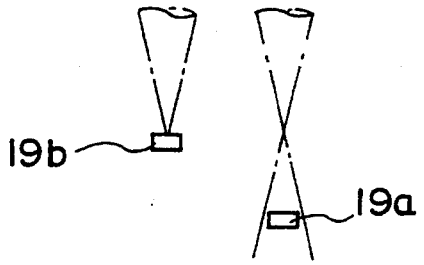
FIG. 20 is a diagram showing the arrangement of photodetectors in the apparatus of FIG. 19.

Referring to FIG. 19, the present embodiment uses the photodetectors 19*a* and 19*b* disposed at respective positions that differ from each other in the axial direction of the optical axis as shown in FIG. 20. Further, there is provided a focusing control unit 49 that controls the focusing of the laser beams by moving the collimator lens 13 in the axial direction of the laser beams.

Figure 21:
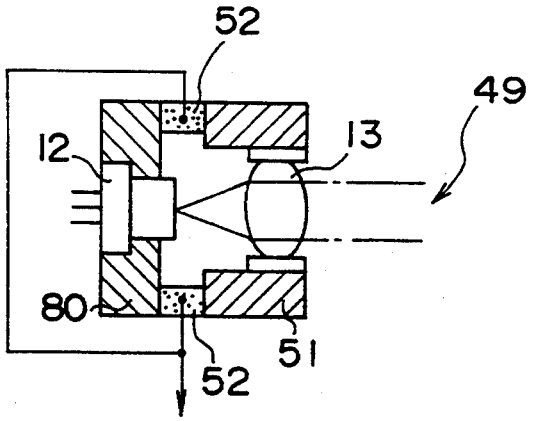
FIG. 21 is a diagram showing the mechanism for adjusting the focusing of the laser beam in the apparatus of FIG. 19 in a cross sectional view.

FIG. 21 shows the construction of the focusing control unit 49.

Referring to FIG. 21, it will be noted that the laser diode 12 is mounted on a holder 80, and the collimator lens 13 is held by another holder 51 and is disposed above the laser diode 12. Further, the holder 51 is mounted on the holder 80 by means of a piezoelectric actuator 52, and the lens 13 is moved in a direction parallel to the optical axis by activating the piezoelectric actuator 52. Thereby, the piezoelectric actuator 52 is driven by a control circuit 53 shown in FIG. 19 wherein the control circuit 53 detects the focusing state of the laser beams based upon the output signals of the photodetectors 19*a* and 19*b*.

For example, when the point of convergence of the laser beams has changed for example by a thermal deformation of the optical system, there occurs a situation as shown in FIG. 20 wherein the beam diameter detected by the photodetector 19*a* increases while the beam diameter on the photodetector 19*b* decreases. Thereby, the photodetector 19*b*, detecting the entirety of the laser beam supplied thereto, produces an output signal that is substantially larger than the photodetector 19*b* that detects only a part of the laser beam supplied thereto. Thereby, the control circuit 53 compares the output signals of the photodetectors 19*a* and 19*b* and controls the piezoelectric actuator 52 such that the difference between both output signals becomes smaller than a predetermined threshold. In response to the activation of the piezoelectric actuator 52 that moves the collimator lens 13, the point of convergence of the laser beams is adjusted. Thereby, the direction of movement of the lens 13 is determined also based upon the output signals of the photodetectors 19*a* and 19*b*.

It should be noted that the foregoing adjustment of the lens 13 is achieved during the idling interval or startup interval of the optical recording apparatus. When the apparatus is used for recording images, on the other hand, the output signals of the photodetectors 19*a* and 19*b* bypasses the circuit 53 for controlling the control circuits 20*a* and 20*b* as usual.

According to the present embodiment, the photodetectors 19*a* and 19*b*, disposed with different positions in the axial direction of the laser beams, detect the focusing state of the laser beams, and the information indicative of deviation of the focusing state is fed back to the piezoelectric actuator 52 via the control circuit 53 and the focusing control unit 49 for proper focusing of the laser beams upon the photodetectors 19*a* and 19*b*. Thereby, a reliable detection of the output optical power of the laser diodes 12*a* and 12*b* becomes possible. As a result, one can minimize the variation in size of the beam spot on the recording medium and a high quality printout can be obtained.

In any of the foregoing first through seventh embodiments, the drive current of the laser diodes 12*a* and 12*b* is controlled by the corresponding control circuits 20*a* and 20*b*, in response to the output of the photodetectors 19*a* and 19*b* such that the output optical power of the laser diodes 12*a* and 12*b* is maintained at a predetermined level.

On the other hand, the foregoing construction of the optical recording system has a drawback in that the focusing of the laser beams upon the photodetectors 19*a* and 19*b* may change when there is a thermal deformation in the holder members that holds the laser diodes 12*a* and 12*b* or the collimator lens 13, as already mentioned with reference to the foregoing seventh embodiment. When such a variation in the focusing occurs in the laser beams, there appears a local variation of sensitivity in the photodetectors and such a local variation of sensitivity in turn induces a variation of the optical output of the laser diodes.

Hereinafter, an eighth embodiment of the present invention, addressing the same problem of the foregoing seventh embodiment though with a simplified construction, will be described with reference to FIG. 22, wherein those parts described previously with reference to previous drawings are designated by the same reference numerals and the description thereof will be omitted.

Figure 22:
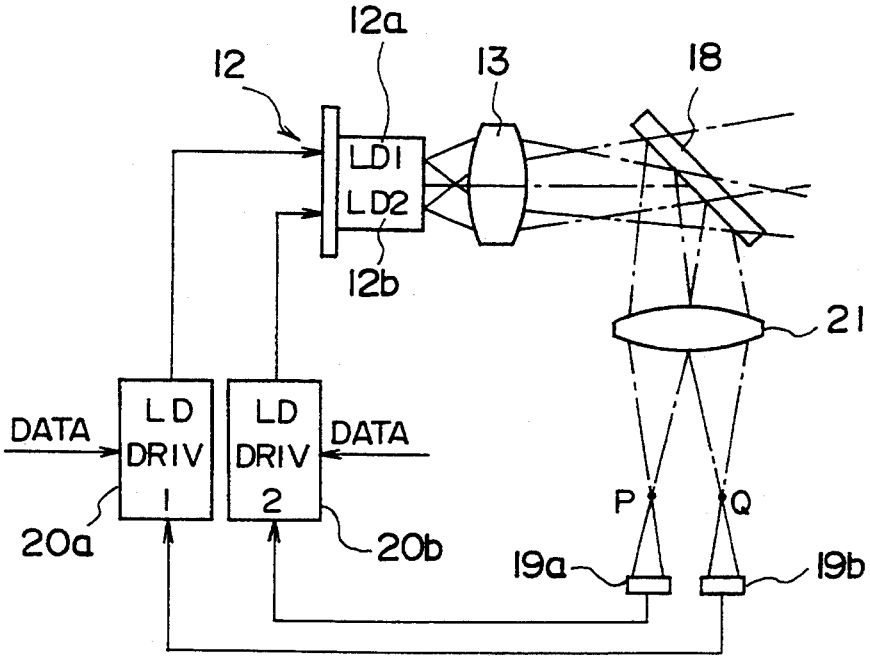
FIG. 22 is a block diagram showing the construction of an optical recording apparatus according to a ninth embodiment of the present invention.

Referring to FIG. 22 showing the construction of the present embodiment, it will be noted that the optical recording apparatus of the present invention has a construction generally identical to FIG. 4 except that the photodetectors 19*a* and 19*b* are disposed offset from the points P and Q showing respectively the point of convergence of the laser beams that have been produced by the laser diodes 12*a* and 12*b*. As shown in FIG. 22, the photodetectors 19*a* and 19*b* are provided with offset in the axial direction of the laser beams. By constructing the apparatus as shown in FIG. 22, a large diameter optical beam enters the photodetectors 19*a* and 19*b*, and one can detect the optical power of the laser beams with reliability in the form of average optical power. Thereby, one can avoid the problem of local variation of sensitivity of the photodetectors 19*a* and 19*b* that may exist in the photoreception surface, and an accurate control of the optical power of the laser diodes 12*a* and 12*b* can be achieved even when a very short drive pulse is supplied to the control circuits 20*a* and 20*b*. The photodetectors 19*a* and 19*b* may be offset in any side of the points P and Q on the respective optical axes.

Figure 23:
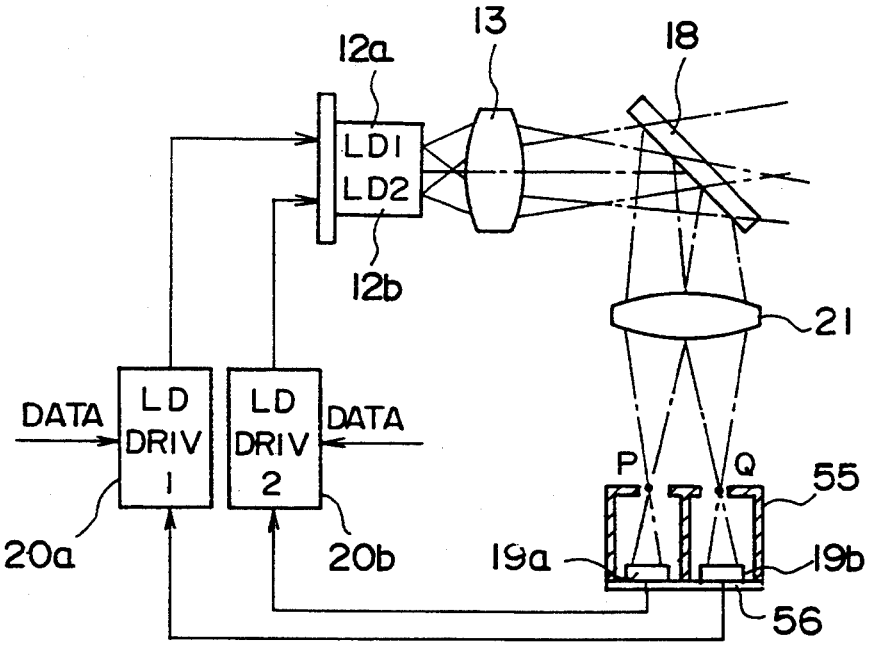
FIG. 23 is a block diagram showing the construction of an optical recording apparatus according to a tenth embodiment of the present invention.

Next, a tenth embodiment of the present invention will be described with reference to FIGS. 23 and 24, wherein those parts described with reference to previous drawings are designated by the corresponding reference numerals.

In the present embodiment, a shade member 55 is provided in the vicinity of the points P and Q for covering the individual photodetectors 19*a* and 19*b*. Thereby, the shade member 55 has openings corresponding to the points P and Q for eliminating the flare associated with the laser beams produced by the laser diodes 12*a* and 12*b*. It should be noted that such a flare is formed as a result of optical scattering and reflection occurring in the collimator lens 13, the semi-transparent mirror 18, the lens 21, and the like. By eliminating the flare, one can eliminate the crosstalk between the laser beams produced by the laser diodes 12*a* and 12*b*. It is advantageous to provide the foregoing openings in correspondence to the points P and Q wherein the beam diameter is minimum and the beam separation is maximum. Thus, the risk of the laser beams interrupted unwantedly by the shade member 55 is minimized.

Figure 24:
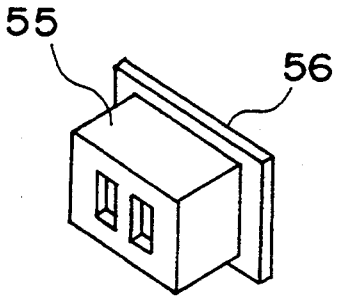
FIG. 24 is a diagram showing the optical shade member used in the apparatus of FIG. 23.

FIG. 24 shows the shade member 55 in a perspective view, wherein it will be noted that the shade member 55 is mounted on a circuit board 56 corresponding to the circuit board 31 of FIG. 8 and carrying thereon the photodetectors 19*a* and 19*b*. Thereby, the illustrated openings correspond to the points P and Q.

Next, an eleventh embodiment of the present invention will be described with reference to FIGS. 25 and 26, wherein those parts corresponding to the parts described previously with reference to previous drawings are designated by the same reference numerals.

Figure 25:
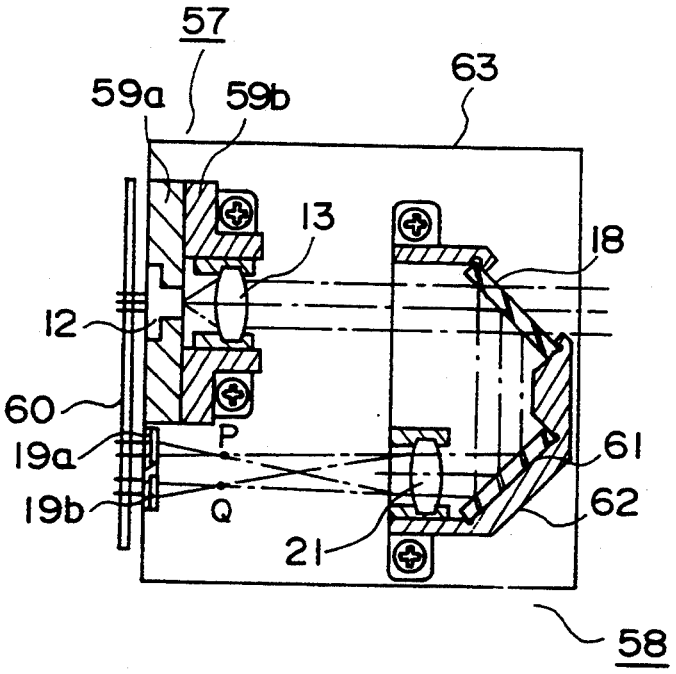
FIG. 25 is a diagram showing the construction of an optical system according to an eleventh embodiment of the present invention.

Referring to FIG. 25, it will be noted that the system of the present embodiment is a modification of the system of FIG. 22. More specifically, the present embodiment uses an integral optical source unit that includes therein a laser diode array unit 57 and a beam splitting unit 58, wherein the unit 57 and the unit 58 are provided on a common substrate 63. There, the laser diode array unit 57 includes the laser diode array 12 described previously and the collimator lens 13, wherein the laser diode array 12 and the collimator lens 13 are mounted on the substrate 63 by means of holders 59*a* and 59*b* respectively, and wherein the holders 59*a* and 59*b* are assembled each other to form a unitary body. Further, there is provided a printed circuit board 60 at a side opposite to the side in which the laser beams are emitted, for carrying thereon a drive circuit corresponding to the circuits 20*a* and 20*b* not shown in FIG. 27. On the other hand, the beam splitting unit 58 includes the semi-transparent mirror 18 and another mirror 61 that are held on the substrate 63 by means of a holder 62 together with the lens 21. The mirrors 18 and 61 and the lens 21 are held on the substrate 63 such that the laser beams emitted at the laser diode array 12 and passed through the collimator lens 13 are split at the semi-transparent mirror 18 and the laser beams thus split pass through the lens 21 after deflection at the mirror 61. According to the present embodiment, it is possible to use the unitary holder for holding both the laser diode array 12 and the collimator lens 13 in the laser diode array unit 57. In the conventional optical recording apparatuses, it should be noted that the laser diode array and the collimator lens are generally held separately by different holder mechanisms. Thereby, the present invention provides an advantageous feature in that the adjustment of optical axis of the laser beams and the adjustment of the collimator lens are achieved simultaneously.

Figure 26:
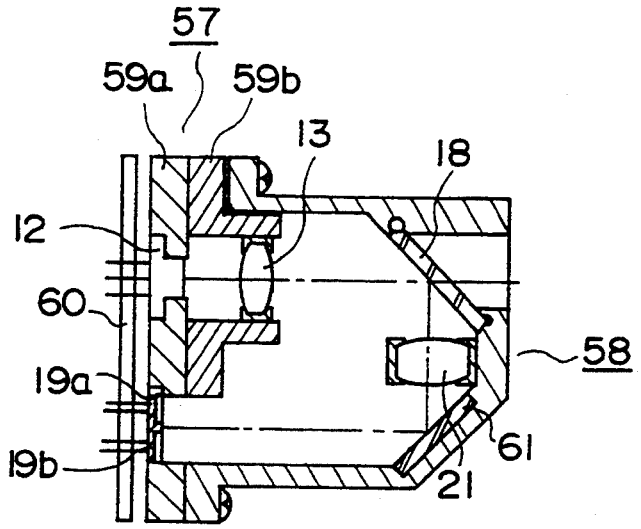
FIG. 26 is a diagram showing a modification of the eleventh embodiment.

FIG. 26 shows a modification of the assembly of FIG. 25, wherein use of the substrate 63 is eliminated and the laser diode array unit 57 is mounted directly upon the beam splitting unit 58. Thereby, one can reduce the number of parts and the size of the assembly.

Next, a twelfth embodiment of the present invention will be described with reference to FIG. 27, wherein those parts described previously with reference to preceding drawings are designated by the same reference numerals and the description thereof will be omitted.

Figure 27:
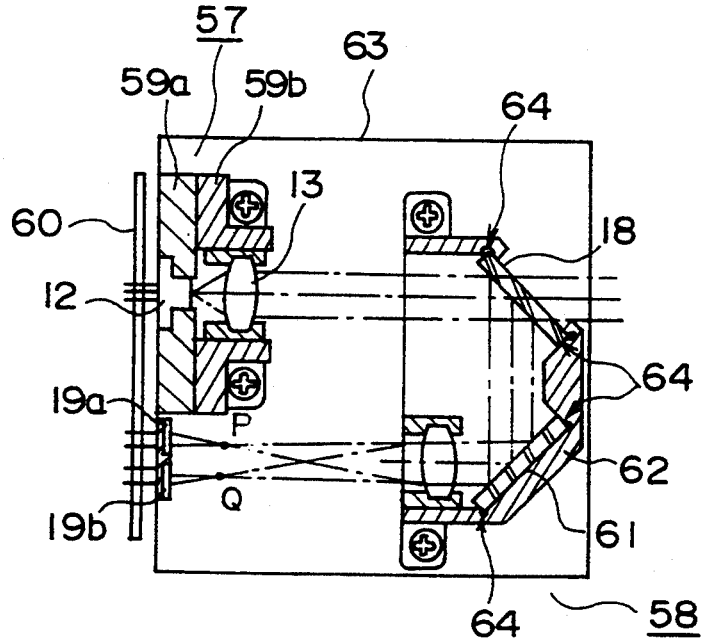
FIG. 27 is a diagram showing the construction of an optical system according to a twelfth embodiment of the present invention.

Referring to FIG. 27, the present embodiment is based upon the construction of FIG. 25, wherein it will be noted that there is provided an adjustment mechanism 64 for adjusting the beam splitting unit 58 in alignment with the laser beams produced by the laser diode array 12. By actuating the beam splitting unit 58, the mirror 61 is moved in the direction in which the photodetectors 19*a* and 19*b* are aligned. According to the present invention, it is possible to eliminate deviation of alignment between the laser beams and the corresponding photodetectors caused for example by the mechanical errors in the laser diode array 12 or in the mirrors 18 and 61 of the beam splitting unit 58. Thereby, an accurate control of the optical power becomes possible for each of the laser diodes in the laser diode array.

Figure 28:
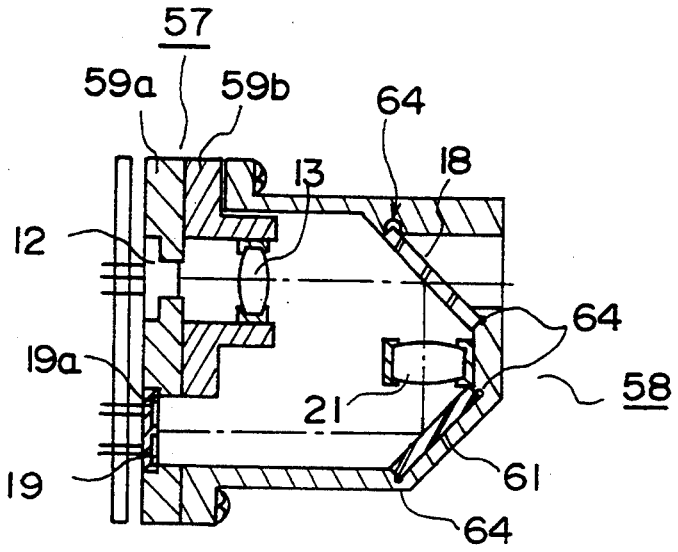
FIG. 28 is a diagram showing a modification of the twelfth embodiment.

FIG. 28 shows a modification of the assembly of FIG. 27, wherein the laser diode array unit 57 and the beam splitting unit 58 are assembled with each other directly. Thereby, one can reduce the number of parts and the size of the assembly similarly to the embodiment of FIG. 26.

Figure 29:
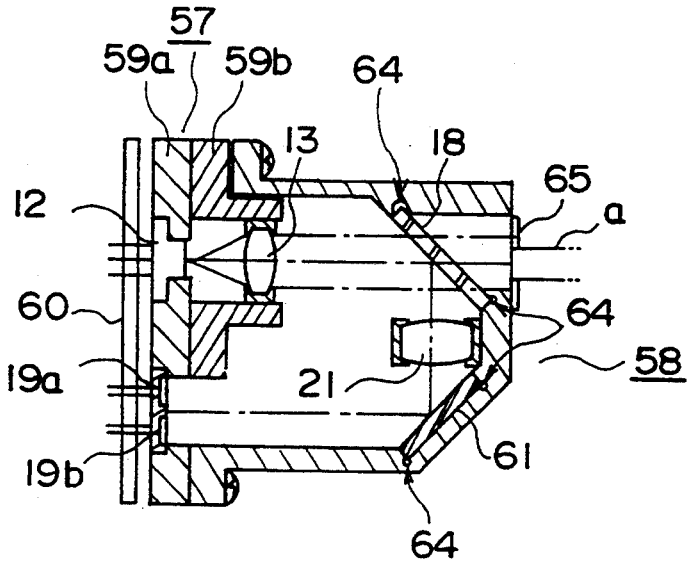
FIG. 29 is a diagram showing the construction of an optical system according to a thirteenth embodiment of the present invention.

Next, a thirteenth embodiment of the present invention will be described with reference to FIG. 29, wherein those parts described previously with reference to preceding drawings are designated by the same reference numerals and the description thereof will be omitted. In the present embodiment, an aperture 65 is provided in an optical path of the laser beams for limiting a beam diameter thereof. Generally, the divergent angle of the laser beams radiated from the laser diodes 12*a* and 12*b* change significantly device by device. In correspondence to this, there is a tendency that the beam spot of the laser beams produced by the laser diodes 12*a* and 12*b* change on the recording medium. Conventionally, an aperture has been used immediately behind the collimator lens 13, when viewed in the propagating direction of the laser beams, for confining the optical flux. However, the use of aperture provided behind the collimator lens 13 invites a decrease in the optical power detected by the photodetectors 19*a* and 19*b*, and such a decrease of optical power in turn degrades the accuracy of control of the optical output power. This problem of poor accuracy of control becomes particularly serious when the drive pulses are supplied with very small pulse widths. In the present embodiment, on the other hand, it is possible to reduce the optical loss and simplify the construction of the control circuits 20*a* and 20*b*.

Next, a fourteenth embodiment of the present invention will be described with reference to FIGS. 30 and 31, wherein those parts described previously with reference to previous drawings are designated by the corresponding reference numerals and the description thereof will be omitted.

Figure 30:
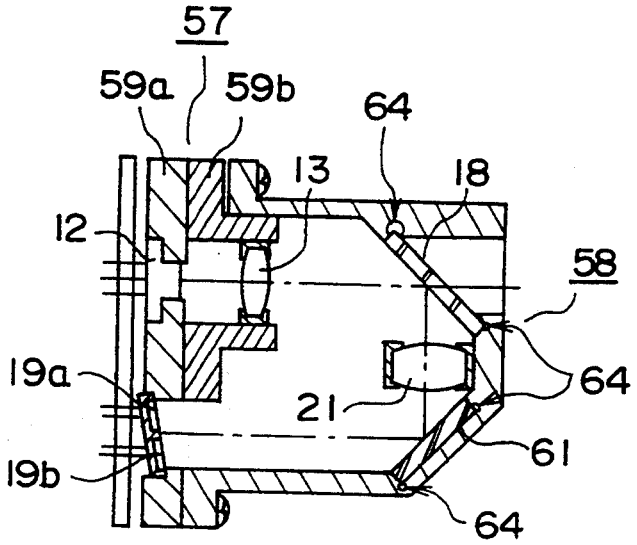
FIG. 30 is a diagram showing the construction of an optical system according to a fourteenth embodiment of the present invention.
Figure 31:
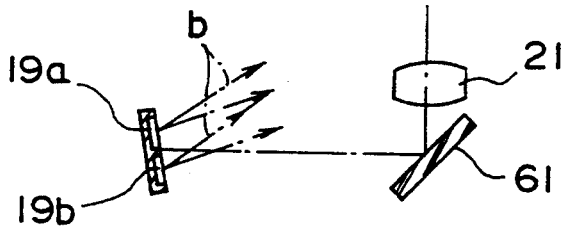
FIG. 31 is a diagram showing the reflection of optical beam occurring in the optical system of FIG. 30.

Referring to FIG. 30, it will be noted that the photodiodes 19*a* and 19*b* are disposed in the present embodiment such that the photoreception surfaces form an oblique angle with respect to the optical axis of the laser beams incident thereto. Thereby, the laser beams reflected at the photoreception surface do not return to the laser diodes 12*a* and 12*b* along a reversal optical path, and the problem of noise in the output of the laser diodes caused by the reflected laser beams is successfully eliminated.

In the foregoing first through fourteenth embodiments, it should be noted that the number of the laser diodes in the laser diode array 12 is not limited to two but any arbitrary number of laser diodes may be used. In correspondence to this, there may be a number of photodetectors in correspondence to the laser diodes.

Further, the present invention is not limited to the embodiments described heretofore, but various variations and modifications may be made without departing from the scope of the present invention.

What is claimed is:

1. An optical recording apparatus, comprising:

a laser diode array including a plurality of laser diodes for producing a plurality of laser beams to form a first optical beam bundle including said plurality of laser beams, each of said plurality of laser diodes being activated independently from each other in response to a drive signal indicative of an image;

an optical system supplied with said first optical beam bundle for focusing each of said laser beams included in said first optical beam bundle, on a surface of a photosensitive body, said optical system including optical scanning means for scanning said first optical beam bundle along a scanning line such that said laser beams included in said first optical beam bundle achieves a scanning over said photosensitive body simultaneously;

beam splitting means provided on a path of said first optical beam bundle between said laser diode array and said optical scanning means, for splitting each of said laser beams to form a second optical beam bundle such that said second optical beam bundle contains laser beams corresponding to the laser beams in said first optical beam bundle and have been split therefrom;

driving means for driving each of said laser diodes forming said laser diode array;

optical detection means provided for detecting said laser beams included in said second optical beam bundle, said optical detection means comprising a plurality of photodetectors corresponding to said laser diodes in said laser diode array in a one-to-one relationship, each of said photodetectors producing an output signal indicative of an optical power of said laser beam incident thereto; and control means supplied with said output signals from said photodetectors in said optical detection means for controlling said driving means such that each of said laser diodes in said laser diode array produces said laser beam with a controlled optical power.

2. An optical recording apparatus as claimed in claim 1, wherein said driving means supplies a first forward bias current to each of said laser diodes forming said laser diode array, such that said laser diodes produce said laser beams upon activation; said control means comprising an opto-electric negative feedback loop supplied with said output signal of said optical detection means and further with a control signal given externally, for supplying a second forward bias current to each of said laser diodes in said laser diode array, such that said optical power of said laser diodes, represented by said output signal of said optical detection means, agrees to a predetermined optical power; said driving means and said control means being configured to supply a forward bias current to said laser diodes in said laser diode array as a sum of said first forward biasing current and said second forward biasing current.

3. An optical recording apparatus as claimed in claim 1, wherein said optical recording apparatus further comprises a substrate having a principal surface for carrying said laser diode array on said principal surface; said substrate further carrying on said principal surface: a collimator lens forming a part of said optical system such that said collimator lens is held on said principal surface of said substrate by means of a holder element that is mounted on said principal surface of said substrate, said collimator lens converting each of said laser beams produced by said laser diodes from a divergent beam to a parallel beam; said photodetectors forming said optical detection means; and said control means; said optical recording apparatus further comprising optical path detour means for directing each of laser beams included said second optical beam bundle produced by said beam splitting means to said corresponding photodetector on said substrate.

4. An optical recording apparatus as claimed in claim 3, wherein said optical recording apparatus further comprises optical waveguide means for directing said laser beams in said second optical beam bundle to corresponding photodetectors in said optical detection means.

5. An optical recording apparatus as claimed in claim 1, wherein said laser diode array comprises a single, rear-side optical detection device provided inside a body of said laser diode array for detecting laser beams produced by said laser diodes and emitted in a backward direction that is opposite to a direction of said laser beams that form said first optical beam bundle, said optical recording apparatus further comprising failure detection means supplied with an output signal of said rear-side optical detection device and an output of said optical detection means for comparing the same, said failure detection means producing an alarm signal upon detection of discrepancy between said output signal of said rear-side optical detection device and said output of said optical detection means.

6. An optical recording apparatus as claimed in claim 1, wherein said optical recording apparatus further comprises optical-axis adjusting means provided in a path of said second optical beam bundle for modifying an optical path of said laser beams included in said second optical beam bundle, in response to said alarm signal produced by said failure detection means, wherein at least one of said photodetectors includes four photodetecting elements disposed to form a four-quadrant photoreception surface wherein each photodetecting element is disposed in a corresponding quadrant of the photoreception surface.

7. An optical recording apparatus as claimed in claim 1, wherein said optical scanning means comprises: a rotary polygonal mirror provided rotatably about a rotational axis and having a plurality of reflecting surfaces arranged to surround said rotational axis, for reflecting said laser beams in said first optical beam bundle, said rotary polygonal mirror being provided such that said laser beams in said first optical beam bundle causes said scanning upon rotation of said rotary polygonal mirror; optical shielding means provided to surround said rotary polygonal mirror for shielding said rotary polygonal mirror optically; a first window provided on said optical shielding means for passing said first optical beam bundle radiated from said laser diode array to said rotary polygonal mirror; and a second window provided on said optical shielding means for passing said first optical beam bundle to said photosensitive body after reflection at said rotary polygonal mirror; wherein said first window comprises a semi-transparent mirror for reflecting a part of said first optical beam bundle to form said second optical beam bundle, said semitransparent mirror thereby forming said beam splitting means.

8. An optical recording apparatus as claimed in claim 1, wherein said optical detection means comprises: at least first and second photodetecting elements for receiving first and second laser beams included in said second optical beam bundle respectively, said first and second photodetecting elements being disposed in alignment with respective optical axis of said first and second laser beams, with respective, mutually different axial positions; and focusing state detection means for detecting a focusing state of said laser beams of said first optical beam bundle on said photosensitive body, based upon output signals of said first and second laser diodes.

9. An optical recording apparatus, comprising:

a laser diode array including a plurality of laser diodes for producing a plurality of laser beams to form a first optical beam bundle including said plurality of laser beams, each of said plurality of laser diodes being activated independently from each other in response to a drive signal indicative of an image;

an optical system supplied with said first optical beam bundle for focusing each of said laser beams included in said first optical beam bundle, on a surface of a photosensitive body, said optical system including an optical scanning means for scanning said first optical beam bundle along a scanning line such that said laser beams included in said first optical beam bundle achieves a scanning over said photosensitive body simultaneously;

beam splitting means provided on a path of said optical beam bundle between said laser diode array and said optical scanning means, for splitting each of said laser beams to form a second optical beam bundle such that said second optical beam bundle contains laser beams corresponding to the laser beams in said first optical beam bundle and are split therefrom;

focusing means for focusing said laser beams in said second optical beam bundle at a point of convergence;

driving means for driving each of said laser diodes forming said laser diode array;

optical detection means provided for detecting said laser beams included in said second optical beam bundle, said optical detection means comprising a plurality of photodetectors provided in correspondence to said plurality of laser diodes, each of said photodetectors producing an output signal indicative of an optical power of said detected laser beam; and control means supplied with said output signal from said optical detection means for controlling said driving means such that each of said laser diodes in said laser diode array produces said laser beam with a controlled optical power;

said plurality of photodetectors being disposed at an axial position, on respective optical axes of said laser beams in said second optical beam bundle, wherein said axial position is set offset from said point of convergence of said laser beams.

10. An optical recording apparatus as claimed in claim 9, wherein said optical detection means comprises optical shielding means for surrounding each of said photodetectors such that incidence of laser beams into said photodetectors is prohibited except for the laser beam that has been produced by the corresponding laser diode, said optical shielding means having an opening for introducing the corresponding laser beam substantially in coincident to a point of convergence of said laser beam.

11. An optical recording apparatus as claimed in claim 9, wherein said laser diode array forms a unitary laser diode array unit; said laser diode array unit including: in addition to said laser diode array, a collimator lens for processing divergent laser beams produced by said plurality of laser diodes included in said laser diode array, first holder means for holding said collimator lens and said laser diode array together, and a print circuit board provided adjacent to said laser diode array at a side opposite to a side in which said laser beams are radiated; wherein said optical recording apparatus further comprises second holder means for holding said beam splitting means and said focusing means together to form a beam splitting unit.

12. An optical recording apparatus as claimed in claim 11, wherein said photodetection unit includes an adjustment mechanism for adjusting said photodetectors in said beam splitting unit in alignment with said laser diodes forming said laser diode array.

13. An optical recording apparatus as claimed in claim 12, wherein an aperture for limiting a beam diameter is provided in an optical path of the optical beam bundle.

14. An optical recording apparatus, comprising:

a laser diode array including a plurality of laser diodes for producing a plurality of laser beams to form a first optical beam bundle including said plurality of laser beams, each of said plurality of laser diodes being activated independently from each other in response to a drive signal indicative of an image;

an optical system supplied with said first optical beam bundle for focusing each of said laser beams included in said first optical beam bundle, on a surface of a photosensitive body, said optical system including an optical scanning means for scanning said first optical beam bundle along a scanning line such that said laser beams included in said first optical beam bundle achieves a scanning over said photosensitive body simultaneously;

beam splitting means provided on a path of said optical beam bundle between said laser diode array and said optical scanning means, for splitting each of said laser beams to form a second optical beam bundle such that said second optical beam bundle contains laser beams corresponding to the laser beams in said first optical beam bundle and are split therefrom;

focusing means for focusing said laser beams in said second optical beam bundle at a point of convergence;

driving means for driving each of said laser diodes forming said laser diode array;

optical detection means provided for detecting said laser beams included in said second optical beam bundle, said optical detection means comprising a plurality of photodetectors provided in correspondence to said plurality of laser diodes, each of said photodetectors having a photoreception surface and producing an output signal indicative of an optical power of said detected laser beam; and control means supplied with said output signal from said optical detection means for controlling said driving means such that each of said laser diodes in said laser diode array produces said laser beam with a controlled optical power;

said plurality of photodetectors being disposed such that said photoreception surface is set obliquely to an optical axis of said focusing means.

* * * * *